US009630698B2

(12) United States Patent
Morota et al.

(10) Patent No.: US 9,630,698 B2
(45) Date of Patent: Apr. 25, 2017

(54) WATER JET PROPULSION WATERCRAFT

(71) Applicant: Yamaha Hatsudoki Kabushiki Kaisha, Iwata-shi, Shizuoka (JP)

(72) Inventors: Koichiro Morota, Shizuoka (JP); Yoshimasa Kinoshita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 60 days.

(21) Appl. No.: 14/708,379

(22) Filed: May 11, 2015

(65) Prior Publication Data

US 2015/0239545 A1 Aug. 27, 2015

Related U.S. Application Data

(63) Continuation of application No. 13/459,276, filed on Apr. 30, 2012, now Pat. No. 9,056,664.

(30) Foreign Application Priority Data

Jul. 6, 2011 (JP) ..... 2011-149722

(51) Int. Cl.

| | |
|---|---|
| ***B63B 35/73*** | (2006.01) |
| ***B63H 11/02*** | (2006.01) |
| ***B63H 21/32*** | (2006.01) |
| ***F01N 3/10*** | (2006.01) |
| ***F01N 11/00*** | (2006.01) |

(Continued)

(52) U.S. Cl.

CPC ..... *B63H 21/32* (2013.01); *B63B 35/73* (2013.01); *B63B 35/731* (2013.01); *B63H 11/02* (2013.01); *F01N 3/10* (2013.01); *F01N 11/007* (2013.01); *F01N 13/00* (2013.01); *F01N 13/008* (2013.01); *F01N 13/10* (2013.01); *F01N 13/12* (2013.01);

(Continued)

(58) Field of Classification Search

CPC ..... B63B 35/73; B63B 35/731; B63H 11/02; B63H 21/32; F01N 3/10; F01N 11/007; F01N 13/00; F01N 13/008; F01N 13/10; F01N 13/12; F01N 2560/025; F02B 61/04

USPC ..... 440/89 R–89 J; 60/274, 276, 285, 60/299–302; 73/114.73; 123/691, 703; 701/109

See application file for complete search history.

(56) References Cited

U.S. PATENT DOCUMENTS 5,644,912 A * 7/1997 Kawamura ..... F01N 11/007 60/276

6,068,530 A * 5/2000 Ozawa ..... B63B 35/731 114/55.53

(Continued)

OTHER PUBLICATIONS

Morota et al., "Water Jet Propulsion Watercraft", U.S. Appl. No. 13/459,276, filed Apr. 30, 2012.

*Primary Examiner* — Ajay Vasudeva

(74) *Attorney, Agent, or Firm* — Keating and Bennett, LLP

(57) ABSTRACT

A water jet propulsion watercraft includes an exhaust passage, a catalyst member, a water lock, a first oxygen sensor, and a second oxygen sensor. The exhaust passage guides exhaust gas from an engine to an exterior of a hull of the watercraft. The catalyst member is arranged inside the exhaust passage. The water lock is arranged in the exhaust passage downstream of the catalyst member. The first oxygen sensor is arranged in the exhaust passage upstream of the catalyst member. The second oxygen sensor is arranged in the exhaust passage at a position downstream of the catalyst member and upstream of the water lock.

18 Claims, 25 Drawing Sheets

(51) Int. Cl.

| | |
|---|---|
| ***F01N 13/00*** | (2010.01) |
| ***F01N 13/10*** | (2010.01) |
| ***F01N 13/12*** | (2010.01) |
| ***F02B 61/04*** | (2006.01) |

(52) U.S. Cl.
CPC ..... *F02B 61/04* (2013.01); *F01N 2560/025* (2013.01)

(56) References Cited

U.S. PATENT DOCUMENTS

| | | | | |
|---|---|---|---|---|
| 6,213,827 | B1 * | 4/2001 | Hattori | B63H 21/32<br>114/55.5 |
| 9,056,664 | B2 * | 6/2015 | Morota | B63H 21/32 |

* cited by examiner

WATER JET PROPULSION WATERCRAFT

BACKGROUND OF THE INVENTION

1. Field of the Invention

The present invention relates to a water jet propulsion watercraft, and more specifically, to a water jet propulsion watercraft that monitors whether a catalytic converter is functioning effectively.

2. Description of the Related Art

Conventionally, a water jet propulsion watercraft is provided with an oxygen sensor for detecting an oxygen concentration of an exhaust gas. For example, a water jet propulsion watercraft disclosed in Laid-open Japanese Patent Application No. 2006-64425 controls an air-fuel ratio of an air-fuel mixture based on an oxygen concentration detected by an oxygen sensor. The water jet propulsion watercraft has an exhaust passage that guides exhaust gas from an engine to an exterior of a hull of the watercraft. A catalytic converter is arranged in the exhaust passage. The oxygen sensor is arranged in the exhaust passage at a position upstream of the catalytic converter.

Laid-open Japanese Patent Application No. H09-184462 discloses a water jet propulsion watercraft in which an oxygen sensor is arranged in a gas collection chamber. The gas collection chamber is connected to a cylinder of an engine. Laid-open Japanese Patent Application No. H09-310630 discloses a water jet propulsion watercraft in which an oxygen sensor is installed in an exhaust probe installation hole. The exhaust probe installation hole is arranged in the exhaust system at a position upstream of a water lock. The exhaust probe installation hole is arranged below and near a maintenance opening. Laid-open Japanese Patent Application No. H11-013569 discloses an oxygen sensor mounting structure for a small boat in which an oxygen sensor is arranged in a volume chamber. The volume chamber is connected to an exhaust passage or a cylinder hole of an engine. Laid-open Japanese Patent Application No. H11-079092 discloses an exhaust apparatus for a boat in which a plurality of exhaust pipes are connected to an engine. The downstream ends of the exhaust pipes are connected to a collector chamber. The oxygen sensor is arranged in the collector chamber. Laid-open Japanese Patent Application No. H11-245895 discloses an exhaust apparatus for a small planing boat in which an oxygen sensor is arranged upstream of a catalytic converter in an exhaust pipe. Additionally, an exhaust temperature sensor is arranged downstream of the catalytic converter in the exhaust pipe. Laid-open Japanese Patent Application No. 2001-200746 discloses an exhaust system for a small boat in which a mounting hole is formed in an exhaust pipe. When the boat is operated during an outgoing inspection, an A/F sensor is installed in the mounting hole. A feedback control is executed based on a detection result obtained with the A/F sensor, and a revision value of a fuel injection amount is determined with respect to a target air-fuel ratio and stored. After the determined revision value is stored, the A/F sensor is removed and the mounting hole is blocked with a bolt. Laid-open Japanese Patent Application No. 2003-205896 discloses an exhaust apparatus for a water jet propulsion watercraft in which an independent exhaust passage extends from each exhaust port of a cylinder block having a plurality of exhaust ports. An oxygen sensor is installed in an upper portion of at least one of the independent exhaust passages.

In recent years, there has been a demand to reduce the amount of harmful substances contained in exhaust gases discharged from engines in consideration of the impact such substances have on the environment. With the water jet propulsion watercraft of Laid-open Japanese Patent Application No. 2006-64425, the amount of harmful substances in the exhaust gas can be reduced by the catalytic converter arranged in the exhaust passage. However, there are situations in which the catalytic converter does not function effectively due to degradation or other causes. In such a case, exhaust gas will be discharged to the outside without having the harmful substances sufficiently reduced. Therefore, it is important to monitor if the catalytic converter is functioning effectively. In the water jet propulsion watercraft disclosed in Laid-open Japanese Patent Application No. 2006-64425, the oxygen sensor is positioned upstream of the catalytic converter. Consequently, it is not possible to monitor whether the catalytic converter is functioning effectively based on a detection result from the oxygen sensor. A similar problem exists in the other mentioned documents because either the oxygen sensor is positioned upstream of the catalytic converter or a catalytic converter is not even provided.

SUMMARY OF THE INVENTION

In order to overcome the problems described above, preferred embodiments of the present invention provide a water jet propulsion watercraft that can monitor whether a catalytic converter is functioning effectively.

A water jet propulsion watercraft according to a preferred embodiment of the present invention includes a hull, an engine, a jet propulsion unit, an exhaust passage, a catalyst member, a water lock, a first oxygen sensor, and a second oxygen sensor. The engine is housed in the hull. The jet propulsion unit is driven by the engine and draws in water from around the hull and jet the water out. The exhaust passage guides exhaust gas from the engine to the outside of the hull. The catalyst member is arranged in the exhaust passage. The water lock is arranged downstream of the catalyst member in the exhaust passage. The first oxygen sensor is arranged in the exhaust passage upstream of the catalyst member. The second oxygen sensor is arranged in the exhaust passage at a position downstream of the catalyst member and upstream of the water lock.

In the water jet propulsion watercraft according to this preferred embodiment of the present invention, the first oxygen sensor is arranged in the exhaust passage at a position upstream of the catalyst member. The second oxygen sensor is arranged downstream of the catalyst member. Consequently, it is possible to monitor whether the catalytic converter is functioning effectively by comparing a detection result from the first oxygen sensor and a detection result from the second oxygen sensor. Additionally, since the second oxygen sensor is arranged upstream of the water lock, the second oxygen sensor can be prevented from getting wet due to water that has backwashed into the exhaust passage. As a result, the reliability of monitoring achieved with the first oxygen sensor and the second oxygen sensor can be improved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A water jet propulsion watercraft according to preferred embodiments of the present invention will now be explained with reference to the drawings. In the figures, "FWD" indicates a forward movement direction of the watercraft and "BWD" indicates a reverse movement direction of the watercraft. "W" indicates a widthwise direction, i.e., a left-right direction, of the water jet propulsion watercraft.

Figure 1:
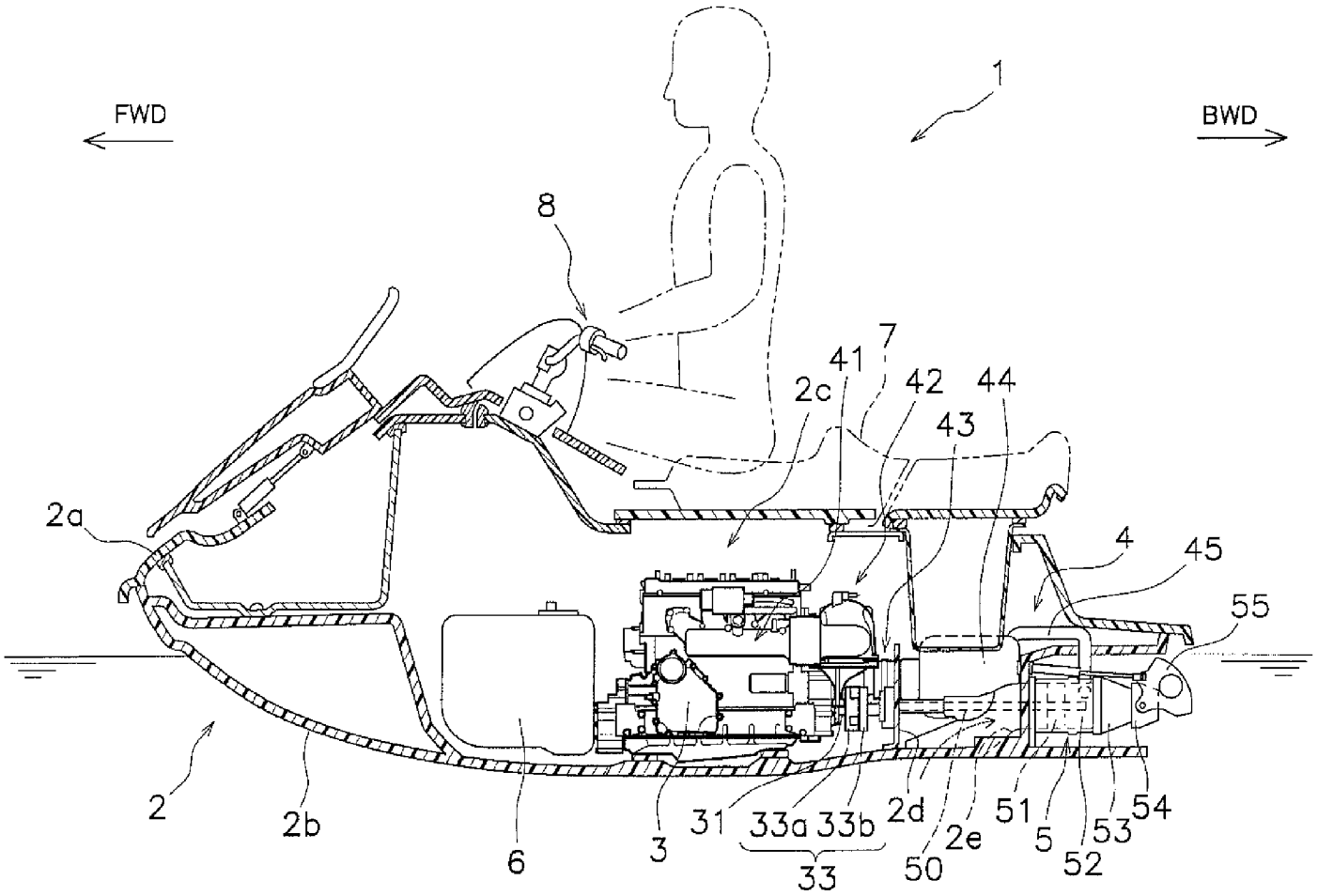
FIG. 1 is a sectional view showing an overall configuration of a water jet propulsion watercraft according to a preferred embodiment of the present invention.

FIG. 1 is a sectional view showing an overall configuration of a water jet propulsion watercraft 1 according to a preferred embodiment of the present invention. The water jet propulsion watercraft 1 is a so-called personal watercraft (PWC). The water jet propulsion watercraft 1 includes a hull 2, an engine 3, an exhaust passage 4, and a jet propulsion unit 5. The hull 2 includes a deck 2*a* and a hull body 2*b*. The engine 3 is housed inside the hull 2. The jet propulsion unit 5 is driven by the engine 3. The exhaust passage 4 guides exhaust gas from the engine 3 to the outside of the hull 2. In other words, the exhaust passage 4 directs exhaust gas from the engine 3 into the water.

An engine room 2*c* is provided inside the hull 2. The engine 3 and a fuel tank 6 are housed inside the engine room 2*c*. A partitioning plate 2*d* is arranged in a rearward section of the engine room 2*c*. The partitioning plate 2*d* is arranged to extend vertically upward from the hull body 2*b*. An upper end of the partitioning plate 2*d* is positioned lower than an upper end of the engine 3. The partitioning plate 2*d* partitions the inside of the hull 2 into a forward section and a rearward section. The partitioning plate 2*d* is configured to prevent the occurrence of rolling. Rolling is phenomenon in which the hull 2 twists about an axis oriented in a longitudinal direction of the hull 2. A seat 7 is attached to the deck 2*a*. The seat 7 is arranged above the engine 3. A steering mechanism 8 for steering the hull 2 is arranged in front of the seat 7.

In the explanations that follow, such directional terms as "front," "rear," "left," "right," and "diagonal" are used from the perspective of a rider sitting on the seat 7 while the water jet propulsion watercraft 1 is floating on still water.

The engine 3 is preferably an inline, four-cylinder, four-stroke engine, for example. The engine 3 includes a crankshaft 31. The crankshaft 31 is arranged to extend in a longitudinal direction. A coupling section 33 is arranged rearward of the crankshaft 31. The coupling section 33 connects an output shaft of the engine 3 to an input shaft of the jet propulsion unit 5. More specifically, the coupling section 33 includes a pair of couplings 33*a* and 33*b*. The coupling 33*a* is fixed to the crankshaft 31. The coupling 33*b* is fixed to an impeller shaft 50 explained below. The couplings 33*a* and 33*b* are connected to the crankshaft 31 and the impeller shaft 50. The couplings 33*a* and 33*b* transmit rotation of the crankshaft 31 to the impeller shaft 50.

The exhaust passage 4 includes a first exhaust pipe 41, a catalytic converter unit 42, a second exhaust pipe 43, a water lock 44, and an exhaust pipe 45. The constituent features of the exhaust passage 4 will be explained in more detail below.

The jet propulsion unit 5 draws in water from around the hull 2 and jets the water out. The jet propulsion unit 5 includes the impeller shaft 50, an impeller 51, an impeller housing 52, a nozzle 53, a deflector 54, and a bucket 55. The impeller shaft 50 is arranged to extend rearward from the engine room 2*c* and pass through the partitioning plate 2*d*. A rearward portion of the impeller shaft 50 passes through a water suction section 2*e* of the hull 2 and out through the inside of the impeller housing 52. The impeller housing 52 is connected to a rearward portion of the water suction section 2*e*. The nozzle 53 is arranged rearward of the impeller housing 52.

The impeller 51 is attached to a rearward portion of the impeller shaft 50. The impeller 51 is arranged inside the impeller housing 52. The impeller 51 rotates together with the impeller shaft 50 and draws in water from the water suction section 2*e*. The impeller 51 jets the drawn water rearward from the nozzle 53. The deflector 54 is arranged rearward of the nozzle 53. The deflector 54 is configured to change a movement direction of water jetted from the nozzle 53 to a leftward or rightward direction. The bucket 55 is arranged rearward of the deflector 54. The bucket 55 is configured to change the movement direction of water jetted from the nozzle 53 and diverted by the deflector 54 to a forward direction.

Figure 2:
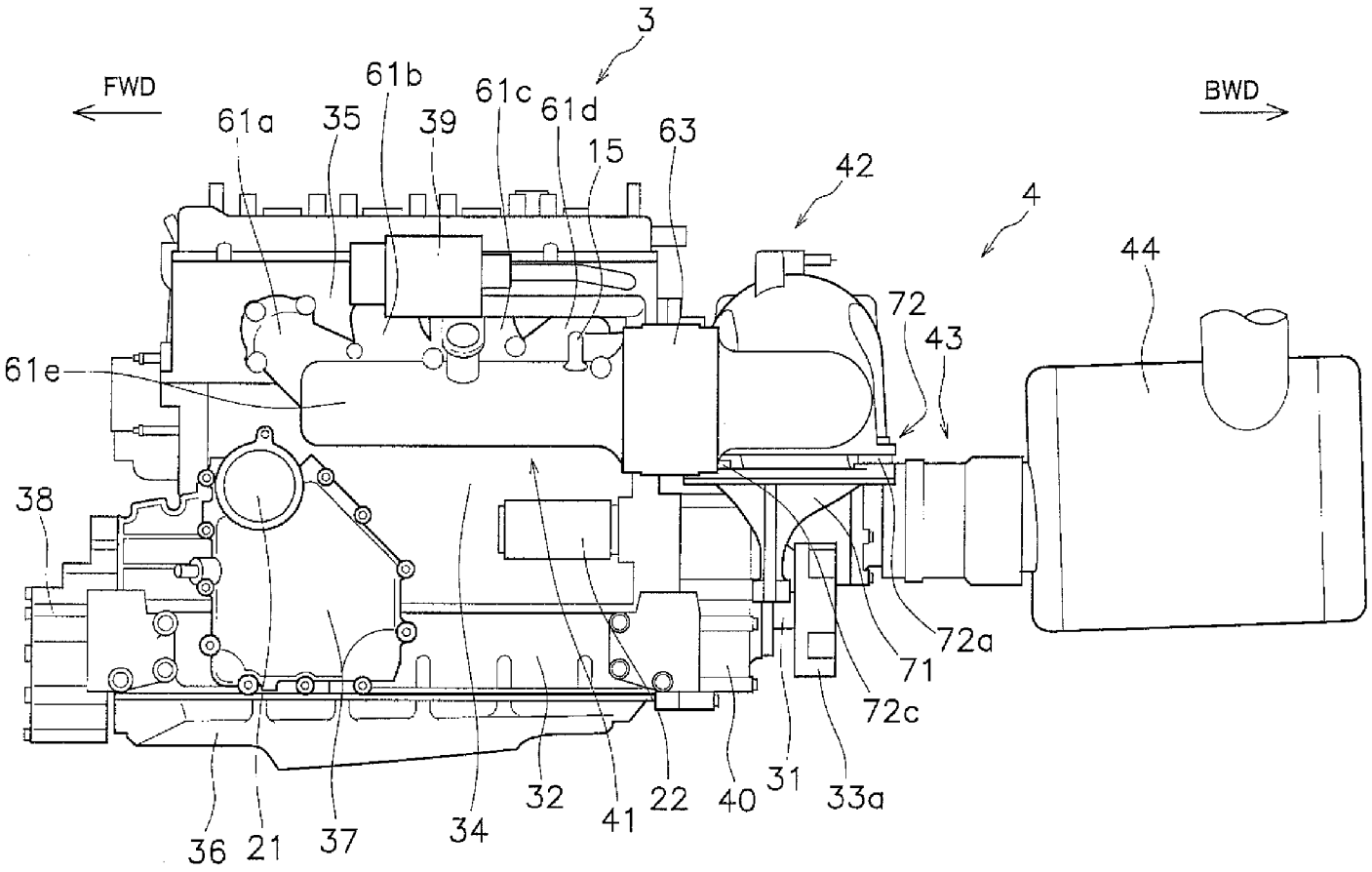
FIG. 2 is a side view of an engine and a portion of an exhaust passage.
Figure 3:
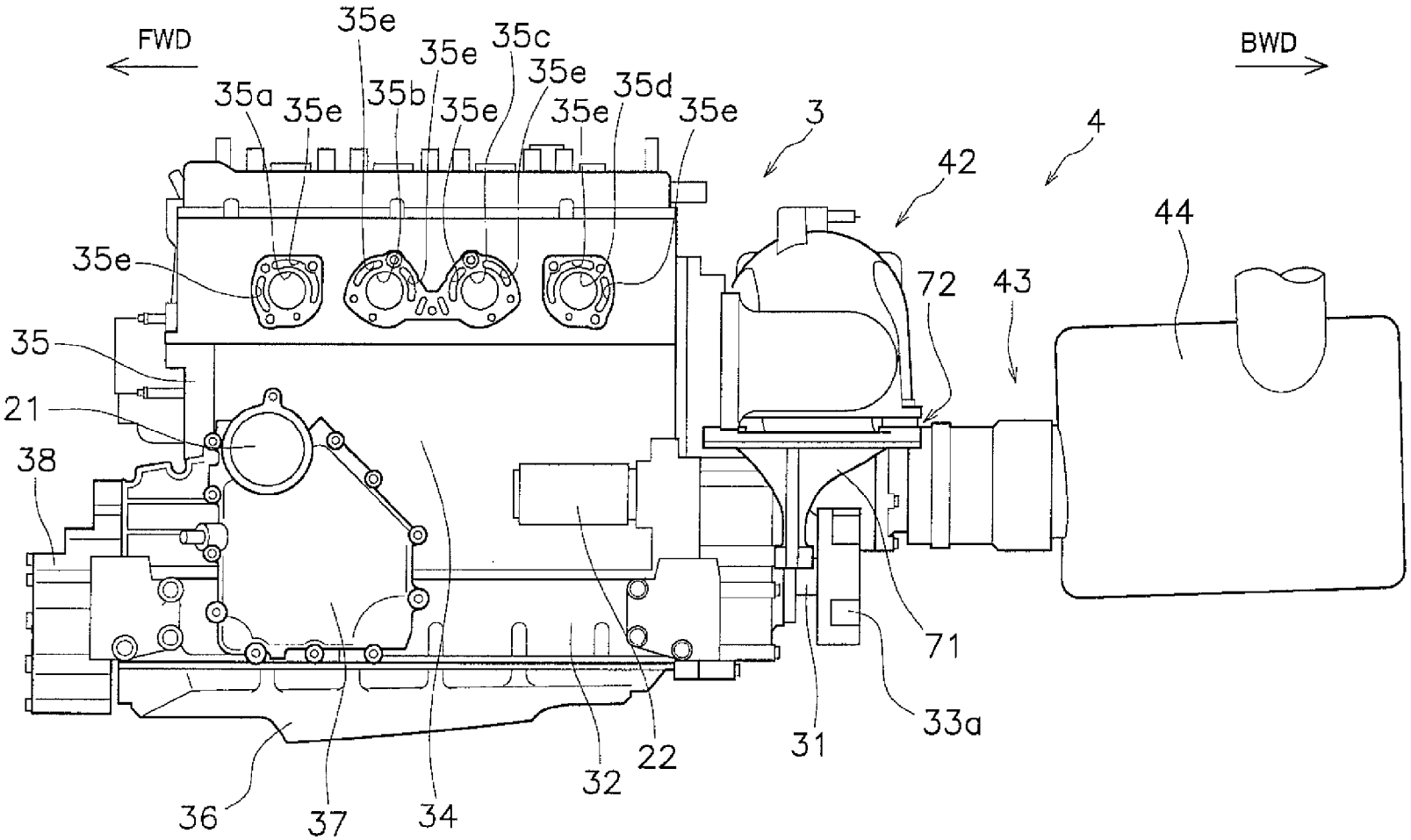
FIG. 3 is a side view a portion of the exhaust passage and the engine with an exhaust manifold removed.

FIG. 2 is a side view of a portion of the engine 3 and the exhaust passage 4. FIG. 3 is a side view of a portion of the exhaust passage 4 and the engine 3 with the exhaust manifold 61 (explained below) removed. The engine 3 includes a crankcase 32, a plurality of cylinders 34, and a cylinder head 35. The crankcase 32 holds the aforementioned crankshaft 31. An oil pan 36 is attached to a bottom portion of the crankcase 32. Oil for lubricating an inside of the engine 3 collects in the oil pan 36. An oil cooler 37 is arranged on a forward portion of a left side surface of the crankcase 32. An oil filter 21 is arranged on a forward portion of a left side surface of the cylinder 34. The oil filter 21 is attached to an upper portion of the oil cooler 37. An oil pump 38 is attached to a forward portion of the crankcase 32. The oil pump 38 is driven by rotation of the crankshaft 31. The oil pump 38 picks up oil from the oil pan 36 and delivers the oil to parts of the engine 3. The oil is cooled in the oil cooler 37. Contaminants mixed in the oil are removed by the oil filter 21. The cylinders 34 and the cylinder head 35 are arranged above the crankcase 32. An electric power storage control device 39 is arranged to a left side of the cylinders 34 and the cylinder head 35. The electric power storage control device 39 is a single device integrating a rectifier and a regulator. The rectifier serves to rectify alternating current generated by a flywheel magnet 29 (see FIG. 9) driven by the engine 3 into direct current. The regulator controls a voltage of electric power stored in a battery (not shown). A starter motor 22 is arranged on a rearward portion of a left side surface of the cylinders 34. Rotation of the starter motor 22 is transmitted through a starter gear 28 shown in FIG. 9 to the crankshaft 31. In this way, the starter motor 22 starts the engine 3. The starter gear 28 is mounted to a rearward portion of the crankshaft 31.

Figure 4:
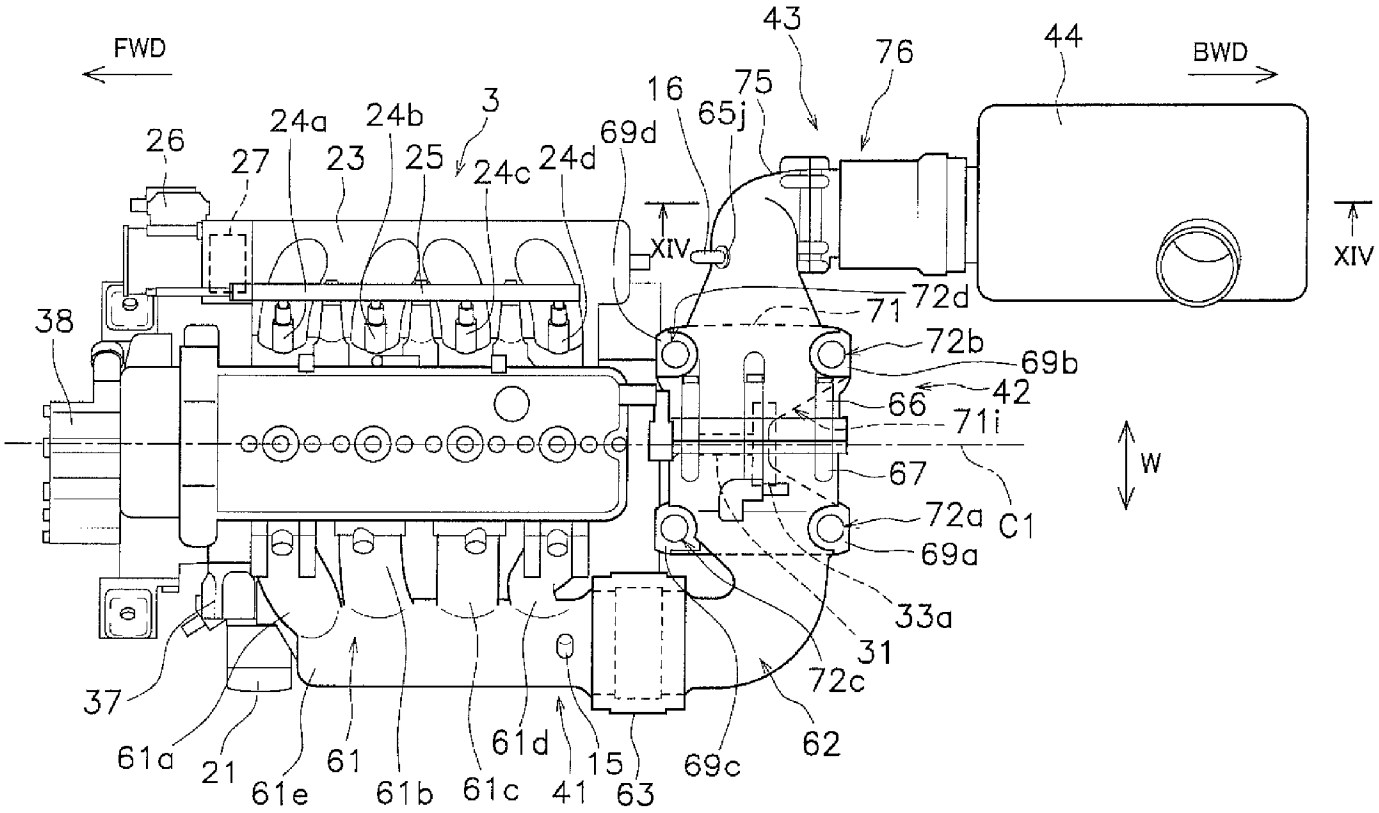
FIG. 4 is a plan view of the engine and a portion of the exhaust passage.

As shown in FIG. 4, an intake manifold 23 is mounted to a left side surface of the cylinder head 35. More specifically, the intake manifold 23 is connected to a plurality of intake ports (not shown) provided on a right side surface of the cylinder head 35. Injectors 24*a* to 24*d* are mounted in the intake manifold 23. The injectors 24*a* to 24*d* serve to inject fuel into the respective intake ports of the cylinder head 35. A fuel delivery pipe 25 is attached to the injectors 24*a* to 24*d*. The fuel delivery pipe 25 is arranged above the intake manifold 23 such that it extends along the longitudinal direction. The fuel delivery pipe 25 is fixed to the intake manifold 23. The fuel delivery pipe 25 supplies fuel from a fuel tank 6 (see FIG. 1) to the injectors 24*a* to 24*d*. A throttle body 26 is arranged in front of the intake manifold 23. The throttle body 26 regulates an amount of air taken into the engine 3. A flame arrestor 27 is arranged between the throttle body 26 and the intake manifold 23. The flame arrester 27 is arranged downstream of the throttle body 26 in terms of the flow of intake air to the engine 3. The flame arrester 27 prevents a flame from propagating upstream beyond the flame arrester 27 when backfiring occurs.

As shown in FIG. 3, the cylinder head 35 includes a plurality of exhaust ports 35*a* to 35*d*. In this preferred embodiment, the cylinder head 35 includes first to fourth exhaust ports 35*a* to 35*d*. Exhaust gas generated by the engine 3 is discharged to the outside of the engine 3 via the first to fourth exhaust ports 35*a* to 35*d*. The first to fourth exhaust ports 35*a* to 35*d* are provided on a side surface of the cylinder head 35. The first to fourth exhaust ports 35*a* to 35*d* are open in a lateral direction of the engine 3. The first to fourth exhaust ports 35*a* to 35*d* are arranged in order as listed from front to rear. That is, the first exhaust port 35*a* is the most forward among the first to fourth exhaust ports 35*a* to 35*d*, and the fourth exhaust port 35*d* is the most rearward among the first to fourth exhaust ports 35*a* to 35*d*. Water flow channels 35*e* are provided around a periphery of each of the first to fourth exhaust ports 35*a* to 35*d*. Water pumped by a jet pump 91 (see FIG. 15) flows through the flow channels 35*e*.

FIG. 4 is a plan view of the engine 3 and a portion of the exhaust passage 4. In FIG. 4, the electric power storage control device 39 shown in FIG. 2 is removed to facilitate understanding of the drawing. The first exhaust pipe 41 is connected to the engine 3. The first exhaust pipe 41 is attached to the first to fourth exhaust ports 35*a* to 35*d*. The first exhaust pipe 41 guides exhaust gas discharged from the engine 3. The first exhaust pipe 41 is connected between the engine 3 and the catalytic converter unit 42. The first exhaust pipe 41 is an example of the "first pipe body" and the "first exhaust pipe" according to a preferred embodiment of the present invention. The first exhaust pipe 41 is fastened to the engine 3. More specifically, the first exhaust pipe 41 is fixed to a side surface of the cylinder head 35 with bolts or other fastening members. The first exhaust pipe 41 preferably extends in the longitudinal direction on one side of the engine 3. The first exhaust pipe 41 is preferably configured to curve toward the other side of the engine 3 at a position rearward of the engine 3. More specifically, the first exhaust pipe 41 extends in the longitudinal direction on a left side of the engine 3. The first exhaust pipe 41 is configured to curve toward the right side of the engine 3 at a position rearward of the engine 3. The first exhaust pipe 41 includes an exhaust manifold 61, a first connecting section 62, and a first joint section 63. The exhaust manifold 61 is connected to the engine 3. The exhaust manifold 61 is preferably made of aluminum or another metal. The exhaust manifold 61 is arranged on a left side of the engine 3 and extends in the longitudinal direction. The exhaust manifold 61 is arranged along a left side surface of the engine 3. The exhaust manifold 61 includes a plurality of branch pipes 61*a* to 61*d* and a collector pipe 61*e*. The branch pipes 61*a* to 61*d* are each connected to the first to fourth exhaust ports 35*a* to 35*d*, respectively. The branch pipes 61*a* to 61*d* are configured to extend laterally from the first to fourth exhaust ports 35*a* to 35*d*, respectively. More specifically, the branch pipes 61*a* to 61*d* are configured to extend laterally and downward from the first to fourth exhaust ports 35*a* to 35*d*. In this preferred embodiment, the plurality of branch pipes 61*a* to 61*d* are first to fourth branch pipes 61*a* to 61*d*. The first to fourth branch pipes 61*a* to 61*d* are arranged in order as listed from front to rear. That is, the first branch pipe 61*a* is the most forward among the first to fourth branch pipes 61*a* to 61*d* and the fourth branch pipe 61*d* is the most rearward among the first to fourth branch pipes 61*a* to 61*d*. The collector pipe 61*e* is arranged on one side of the engine 3 and extends in the longitudinal direction. As shown in FIG. 2, an upper surface and a lower surface of the collector pipe 61*e* are substantially horizontal in a side view. A diameter of the collector pipe 61*e* is substantially uniform along the longitudinal direction. Ina side view, an axial centerline AX1 (see FIG. 5) of the collector pipe 61*e* is positioned below the first to fourth exhaust ports 35*a* to 35*d*.

Figure 5:
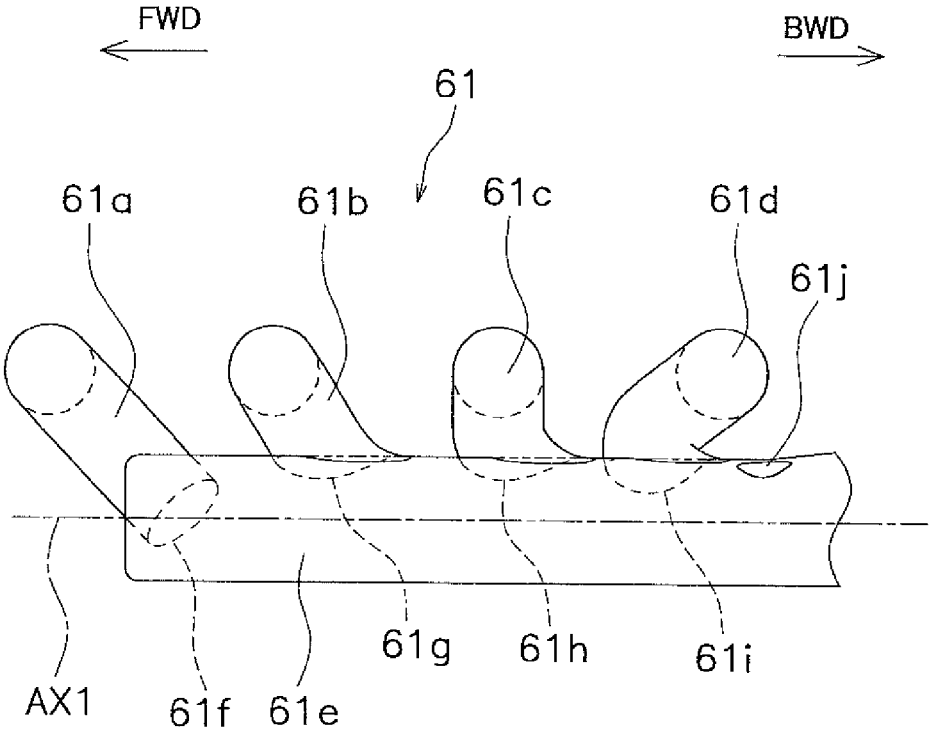
FIG. 5 is a side view of the exhaust manifold.

FIG. 5 is a side view of the exhaust manifold 61. The collector pipe 61*e* is configured to merge the exhaust gases from the branch pipes 61*a* to 61*d*. More specifically, the first to fourth branch pipes 61*a* to 61*d* are each connected to the collector pipe 61*e*. The collector pipe 61*e* includes a plurality of connection openings 61*f* to 61*i*. That is, the connection openings 61*f* to 61*i* are the first to fourth connection openings 61*f* to 61*i*. The first to fourth connection openings 61*f* to 61*i* are arranged in order as listed from front to rear. That is, the first connection opening 61*f* is the most forward among the first to fourth connection openings 61*f* to 61*i* and the fourth connection opening 61*i* is the most rearward among the first to fourth connection openings 61*f* to 61*i*. The first connection opening 61*f* connects to the first branch pipe 61*a*. The second connection opening 61*g* connects to the second branch pipe 61*b*. The third connection opening 61*h* connects to the third branch pipe 61*c*. The fourth connection opening 61*i* connects to the fourth branch pipe 61*d*.

The collector pipe 61*e* includes a first sensor port 61*j*. The first sensor port 61*j* is positioned downstream of the fourth connection opening 61*i*. As shown in FIG. 2 and FIG. 4, a first oxygen sensor 15 is installed in the first sensor port 61*j*. The first sensor port 61*j* is positioned downstream of a region including the fourth connection opening 61*i*. Thus, the first oxygen sensor 15 is positioned downstream of a region including the fourth connection opening 61*i*. The first oxygen sensor 15 is arranged in the exhaust passage 4 at a position upstream of the catalyst member 64 (explained below). The first oxygen sensor 15 is arranged in the first exhaust pipe 41 at a position upstream of the first joint section 63. The first oxygen sensor 15 detects an oxygen concentration in the exhaust gas flowing through the exhaust passage 4.

As shown in FIG. 4, the first joint section 63 connects the exhaust manifold 61 and the first connecting section 62 together. The first joint section 63 is arranged downstream of the exhaust manifold 61. The first joint section 63 is arranged rearward of the exhaust manifold 61. The first joint section 63 is preferably made of a flexible material, e.g., rubber. The first joint section 63 has a cylindrical shape. An external diameter of the first joint section 63 is larger than an external diameter of the collector pipe 61*e*. A downstream end portion of the exhaust manifold 61 is inserted into the joint section 63. As a result, the exhaust manifold 61 is connected to the first joint section 63. The first joint section 63 is an example of the "flexible pipe section" according to a preferred embodiment of the present invention.

The first connecting section 62 is arranged downstream of the first joint section 63. The first connecting section 62 is arranged rearward of the first joint section 63. The first connecting section 62 is preferably configured to curve toward the catalytic converter unit 42. The first connecting section 62 preferably is made of aluminum or another metal. A downstream end portion of the first connecting section 62 is inserted into the first joint section 63. As a result, the first connecting section 62 is connected to the first joint section 63.

The catalytic converter unit 42 is arranged downstream of the first connecting section 62. The catalytic converter unit 42 is connected to the first exhaust pipe 41. The catalytic converter unit 42 is arranged to face a rear surface of the cylinder head 35.

Figure 6:
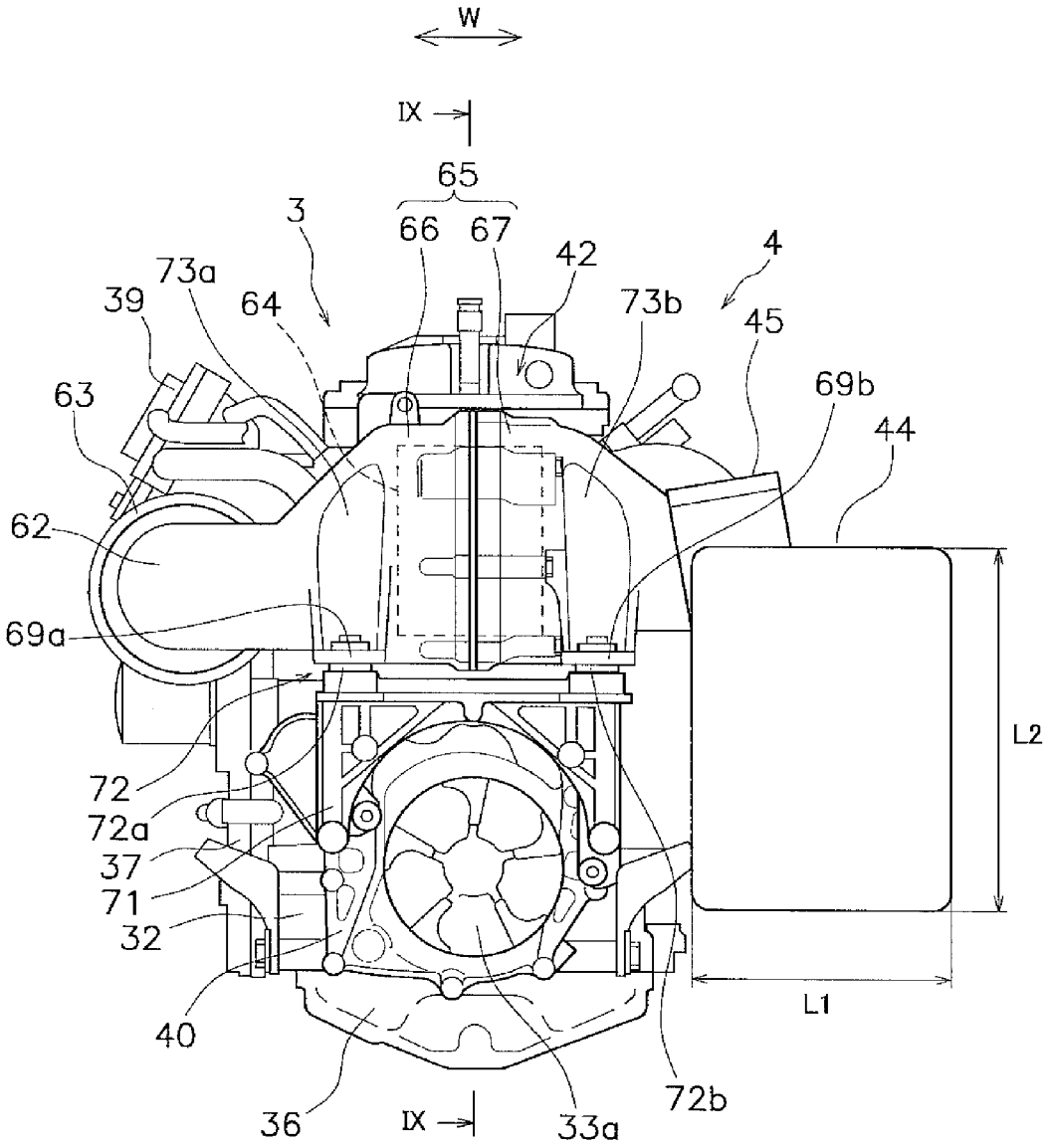
FIG. 6 is a rear view of the engine and a portion of the exhaust passage.
Figure 7:
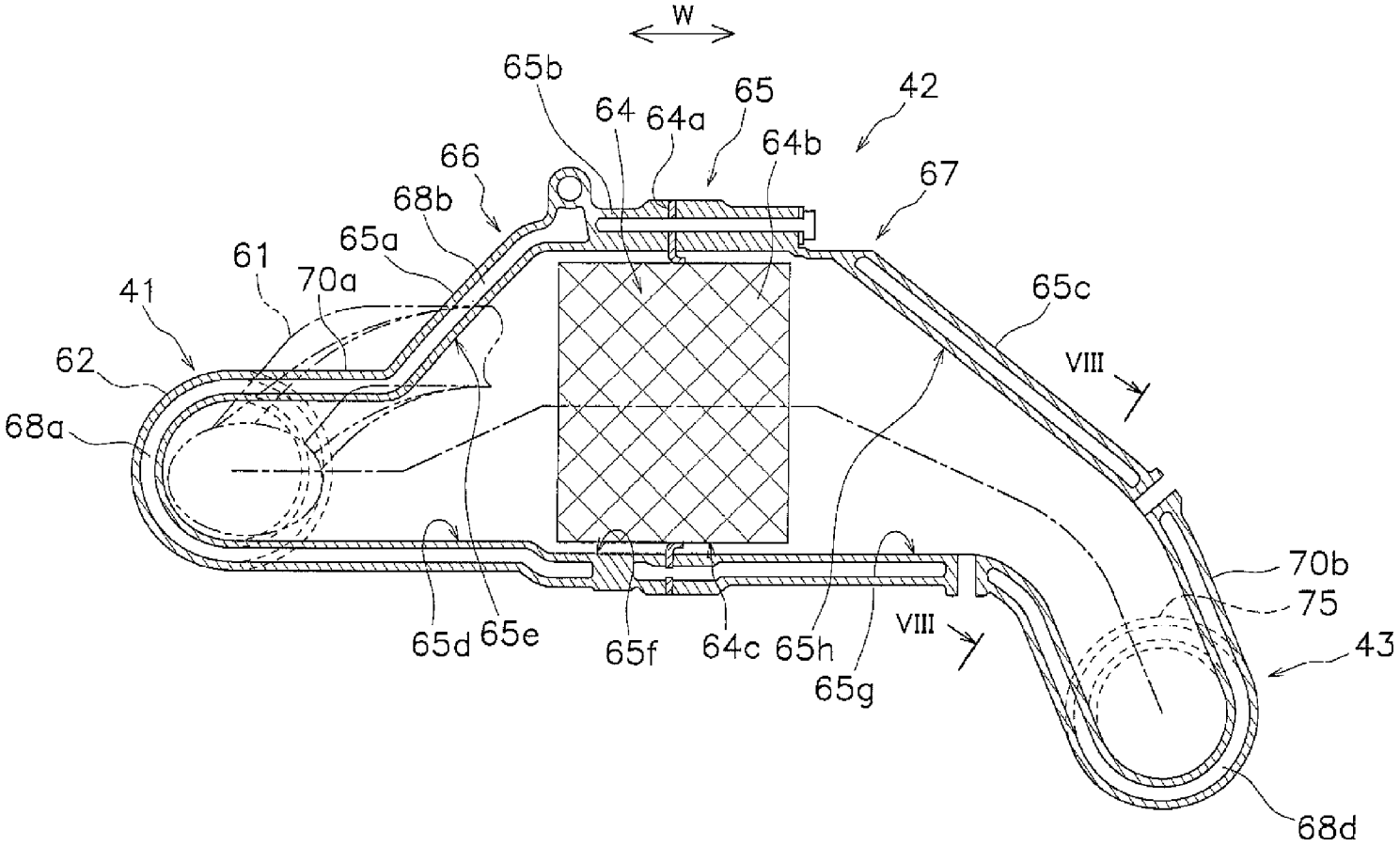
FIG. 7 is a sectional view of a catalytic converter unit.

FIG. 6 is a rear view of the engine 3 and a portion of the exhaust passage 4. FIG. 7 is a sectional view of the catalytic converter unit 42 along a vertical plane that includes an axial centerline of the catalytic converter unit 42. The catalytic converter unit 42 includes a catalyst member 64 and a catalyst housing pipe 65. The catalyst housing pipe 65 houses the catalyst member 64. The catalyst housing pipe 65 preferably is made of aluminum or another metal. The catalyst housing pipe 65 is an example of the "second pipe body," the "pipe section," and the "first pipe section" according to a preferred embodiment of the present invention. The catalyst member 64 is arranged inside the exhaust passage 4. The catalyst member 64 serves to accelerate reactions of components (e.g., HC, CO, NOx) contained in the exhaust gas. The catalyst member 64 can cause components (e.g., HC, CO, NOx) contained in the exhaust gas to react efficiently when it is at or above a prescribed temperature (approximately 300° C.). Therefore, the catalyst member 64 is provided near the first to fourth exhaust ports 35*a* to 35*d* of the engine 3 such that the temperature of the exhaust gas will not decrease before the exhaust gas reaches the catalyst member 64.

More specifically, the catalytic converter unit 42 is arranged to face a rear surface of the cylinder head 35 of the engine 3. The catalytic converter unit 42 is arranged rearward of the cylinder head 35. The catalytic converter unit 42 is arranged to extend along the widthwise direction of the watercraft in a region abutting a rear side of the cylinder head 35. As shown in FIG. 3, the catalytic converter unit 42 is arranged at approximately the same height position as the first to fourth exhaust ports 35*a* to 35*d*. As shown in FIG. 4, the catalytic converter unit 42 is arranged above the crankshaft 31 of the engine 3. The catalytic converter unit 42 is arranged to overlap the centerline C1 passing through the crankshaft 31 in a plan view of the engine. More specifically, in a plan view of the engine, a front portion of the catalytic converter unit 42 overlaps a rear end portion of the crankshaft 31.

The catalyst housing pipe 65 is arranged to face a rear surface of the engine 3. The catalyst housing pipe 65 is configured to extend in a widthwise direction of the watercraft. The catalyst housing pipe 65 includes a first catalyst housing pipe 66 and a second catalyst housing pipe 67. The first catalyst housing pipe 66 and the second catalyst housing pipe 67 are separate entities. The first catalyst housing pipe 66 and the second catalyst housing pipe 67 are arranged adjacently along an axial direction of the catalytic converter unit 42. That is, the first catalyst housing pipe 66 and the second catalyst housing pipe 67 are arranged adjacently along the widthwise direction of the watercraft. The first catalyst housing pipe 66 is formed as an integral or unitary unit with the first connecting section 62. The second catalyst housing pipe 67 is formed as an integral or unitary unit with a second connecting section 75 of the second exhaust pipe 43 (explained below). It is also acceptable if the second catalyst housing pipe 67 is a separate entity from the second connecting section 75 of the second exhaust pipe 43.

As shown in FIG. 7, the catalyst member 64 includes a flange section 64*a* and a catalyst carrier 64*b*. The catalyst carrier 64*b* is a cylindrical member that includes, for example, a honeycomb structure and serves to hold the catalyst. The catalyst carrier 64*b* is preferably made of metal in this preferred embodiment, but it is acceptable for the carrier to be made of ceramic. The flange section 64*a* has an annular shape. The flange section 64*a* is fixed to an outer circumferential surface of the catalyst carrier 64*b*. The flange section 64*a* is configured to protrude outward in a radial direction from the outer circumferential surface of the catalyst carrier 64*b*. The catalyst member 64 is held in the catalyst housing pipe 65 by the flange section 64*a* being pinched between the first catalyst housing pipe 66 and the second catalyst housing pipe 67. The flange section 64*a*, the first catalyst housing pipe 66, and the second catalyst housing pipe 67 are fastened together with bolts or other fastening members.

The catalyst housing pipe 65 includes a straight section 70*a*, an increasing diameter section 65*a*, a housing section 65*b*, a decreasing diameter section 65*c*, and a sloped section 70*b*. The straight section 70*a* is connected to the first exhaust pipe 62. A bottom portion of an inner surface of the straight section 70*a* is configured to extend horizontally in the widthwise direction of the watercraft. An upper portion of an inner surface of the straight section 70*a* is configured to extend horizontally in the widthwise direction of the watercraft. The increasing diameter section 65*a* is positioned upstream of the catalyst member 64. The increasing diameter section 65*a* is configured such that a cross-sectional area of the increasing diameter section 65*a* gradually increases as it extends in a downstream direction. A bottom section 65*d* of an inner surface of the increasing diameter section 65*a* is configured to extend horizontally in the widthwise direction of the watercraft. An upper section 65*e* of the inner surface of the increasing diameter section 65*a* is sloped upward as it extends in the downstream direction. The housing section 65*b* is positioned between the increasing diameter section 65*a* and the decreasing diameter section 65*c*. The housing section 65*b* houses the catalyst member 64. A bottom section 65*f* of an inner surface of the housing section 65*b* is configured to extend horizontally in the widthwise direction of the watercraft. The bottom section 65*f* of the inner surface of the housing section 65*b* is preferably positioned lower than the bottom section 65*d* of the inner surface of the increasing diameter section 65*a*. The catalyst member 64 is arranged such that a gap exists with respect to the inner surface of the housing section 65*b*. A bottom section 64*c* of the catalyst carrier 64*b* is positioned at approximately the same height as the bottom section 65*d* of the inner surface of the increasing diameter section 65*a*. The decreasing diameter section 65*c* is positioned downstream of the catalyst member 64. The decreasing diameter section 65*c* is configured such that a cross-sectional area of the decreasing diameter section 65*c* gradually decreases as it extends in a downstream direction. A bottom section 65*g* of an inner surface of the decreasing diameter section 65*c* is configured to extend horizontally in the widthwise direction of the watercraft. An upper section 65*h* of the inner surface of the decreasing diameter section 65*c* is sloped downward as it extends in the downstream direction. The sloped section 70*b* connects to the second exhaust pipe 43 (explained below). A bottom portion of the inner surface of the sloped section 70*b* is sloped downward as it extends in the downstream direction. An upper portion of the inner surface of the sloped section 70*b* is sloped downward as it extends in the downstream direction. The bottom sections of the inner surfaces of the first exhaust pipe 41, the catalytic converter unit 42, and the second exhaust pipe 43 are preferably configured such there are no portions where the bottom section of the inner surface rises as they proceed in the downstream direction.

Figure 8:
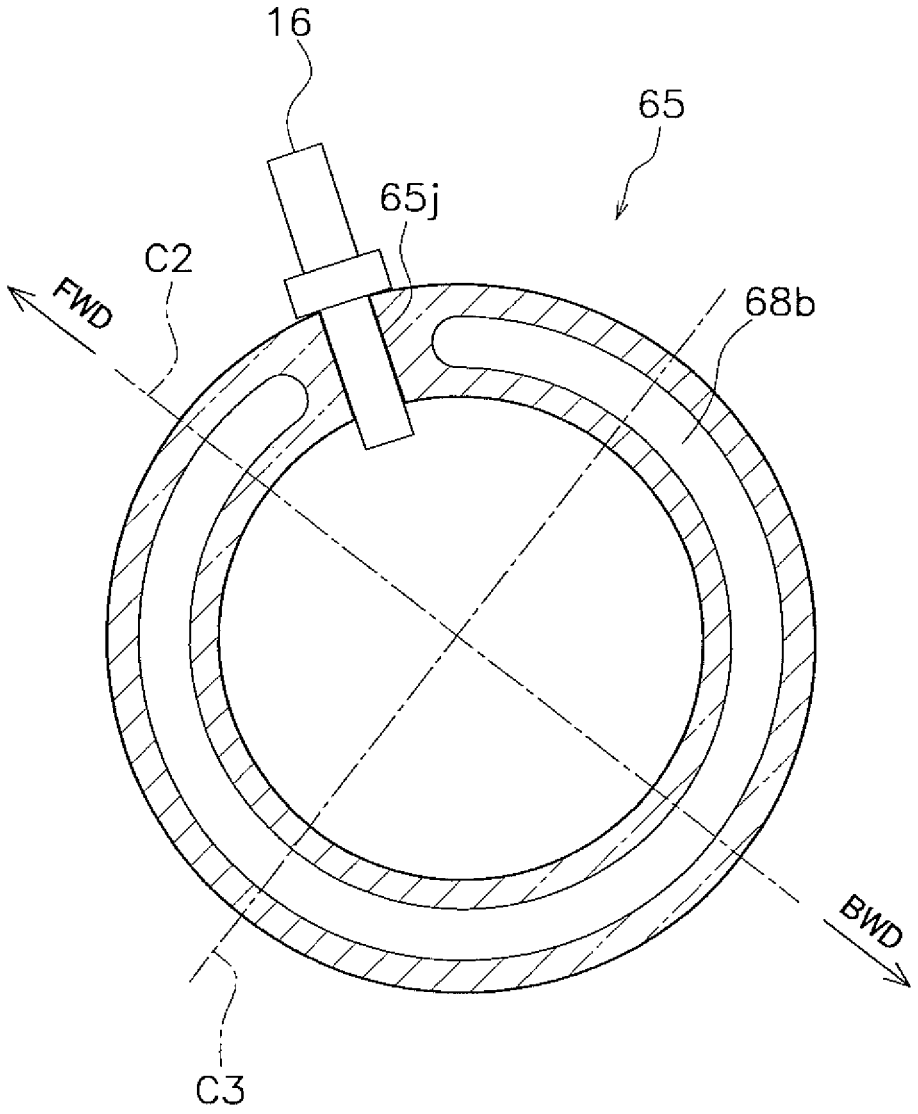
FIG. 8 is a sectional view taken along a section line VIII-VIII of FIG. 7.

As shown in FIG. 4, the catalyst housing pipe 65 includes a second sensor port 65*j*. A second oxygen sensor 16 is installed in the second sensor port 65*j*. The second sensor port 65*j* is positioned downstream of the catalyst member 64. Thus, the second oxygen sensor 16 is arranged downstream of the catalyst member 64. Meanwhile, the second oxygen sensor 16 is arranged upstream of the water lock 44. More specifically, the second sensor port 65*j* is provided in the decreasing diameter section 65*c*. Thus, the second oxygen sensor 16 is arranged in the decreasing diameter section 65*c* of the exhaust passage 4. FIG. 8 is a sectional view taken along a section line VIII-VIII of FIG. 7. As shown in FIG. 8, in a cross-section perpendicular to an axial centerline of the catalyst housing pipe 65, the second oxygen sensor 16 is arranged higher than a longitudinally oriented centerline C2 in the longitudinal direction of the watercraft and closer to the engine 3 than a vertically oriented centerline C3.

Figure 9:
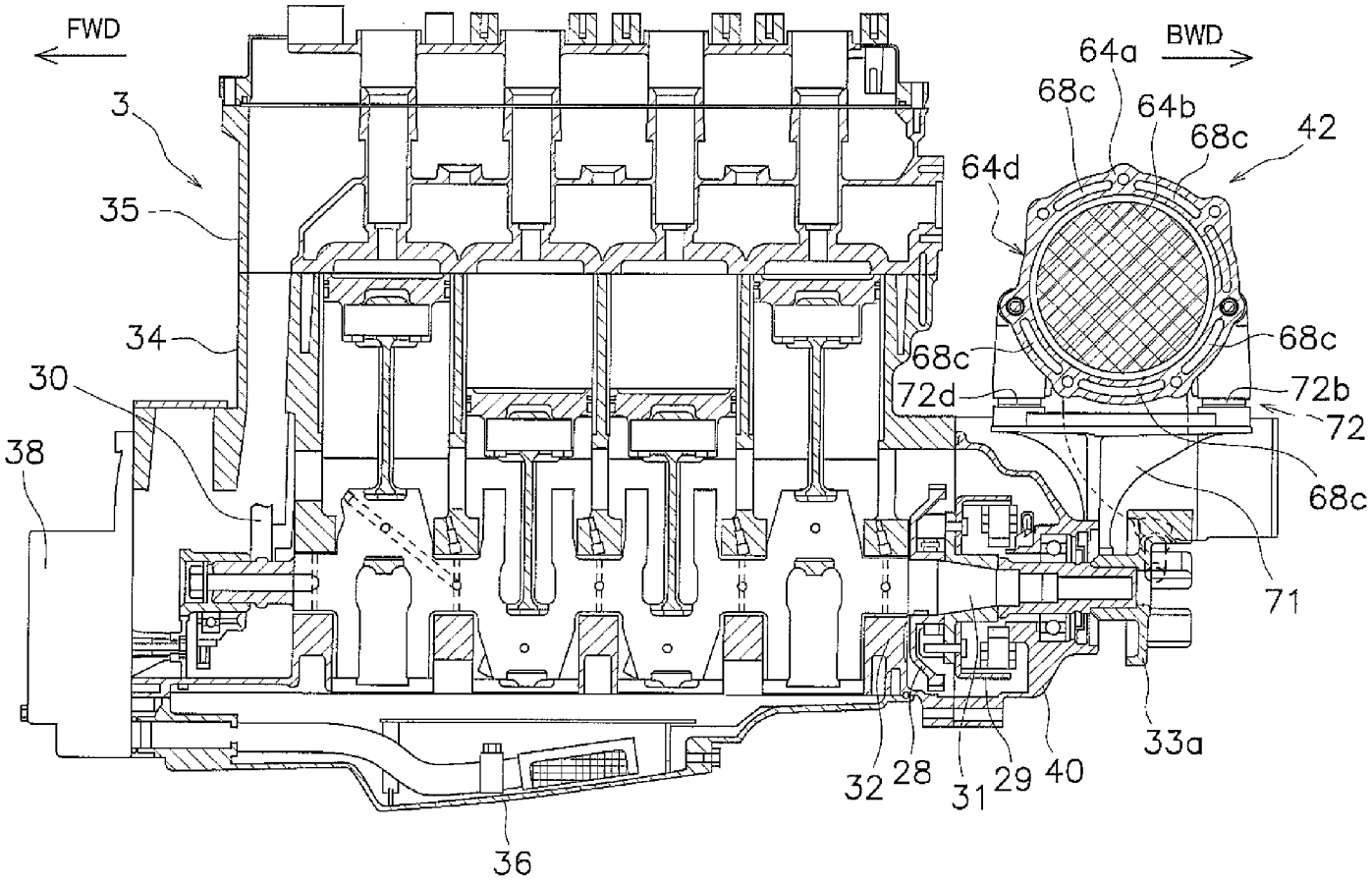
FIG. 9 is a sectional view taken along a section line IX-IX of FIG. 6.

As shown in FIG. 7, a water jacket section 68*b* is provided in the catalyst housing pipe 65. The water jacket section 68*b* is arranged between an outer surface and an inner surface of the catalyst housing pipe 65 and defines a flow channel through which water can pass. The water jacket section 68*b* is configured to keep the catalytic converter unit 42 from reaching too a high temperature due to the flow of exhaust gas. A water jacket section 68*a* is provided in the first exhaust pipe 41. The water jacket section 68*a* of the first exhaust pipe 41 communicates with the water flow channels 35*e* (see FIG. 3) of the engine 3. The water jacket section 68*b* of the catalytic converter unit 42 communicates with the water jacket section 68*a* of the first exhaust pipe 41. The water jacket section 68*b* is configured to surround a periphery of the catalyst member 64 through which exhaust gas flows. The catalytic converter unit 42 is cooled by the flow of water through the water jacket section 68*b*. FIG. 9 is a sectional view taken along a section line IX-IX of FIG. 6. As shown in FIG. 9, a water jacket section 68*c* is provided in the flange section 64*a* of catalyst member 64. The water jacket section 68*c* of the flange section 64*a* communicates with the water jacket section 68*b* of the catalyst housing pipe 65. In this way, the catalyst member 64 is cooled without water directly contacting the catalyst carrier 64*b*. As shown in FIG. 9, the water jacket section 68*c* is not provided in a portion of the flange section 64*a* that faces the cylinder head 35. A recessed section 64*d* is provided in the portion of the flange section 64*a* that faces the cylinder head 35. The recessed section 64*d* is shaped to recess toward in inward side of the flange section 64*a*. That is, the recessed section 64*d* is shaped to recess away from the cylinder head 35. Shaping the flange section 64*a* in this manner enlarges a gap between the flange section 64*a* and the cylinder head 35.

As shown in FIGS. 2, 4, and 6, the catalytic converter unit 42 is preferably supported on the engine 3 with a support bracket 71 and a damper section 72. The support bracket 71 is arranged below the catalytic converter unit 42. The support bracket 71 is fixed to the engine 3. More specifically, the support bracket 71 is fixed to a cover member 40 (flywheel magnet cover) and a crankcase 32 of the engine 3. The cover member 40 is attached to a rear portion of the crankcase 32. As shown in FIG. 9, a flywheel magnet 29 is arranged inside the cover member 40. The flywheel magnet 29 is mounted to a rearward portion of the crankshaft 31. The flywheel magnet 29 generates electricity utilizing rotation of the crankshaft 31. A cam chain 30 is wrapped around a front portion of the crankshaft 31. The cam chain 30 serves to transmit rotation of the crankshaft 31 to intake valves and exhaust valves via a camshaft (not shown).

The damper section 72 reduces vibrations from the engine 3. The damper section 72 includes a plurality of dampers 72*a* to 72*d* preferably made of rubber or another elastic material. More specifically, the damper section 72 includes first to fourth dampers 72*a* to 72*d*. As shown in FIG. 4, the first damper 72*a* is arranged leftward of the center line C1 passing through the crankshaft 31. The second damper 72*b* is arranged rightward of the centerline C1 passing through the crankshaft 31. The third damper 72*c* is arranged forward of the first damper 72*a*. The third damper 72*c* is arranged leftward of the centerline C1 passing through the crankshaft 31. The fourth damper 72*d* is arranged forward of the second damper 72*b*. The fourth damper 72*d* is arranged rightward of the centerline C1 passing through the crankshaft 31.

Figure 10:
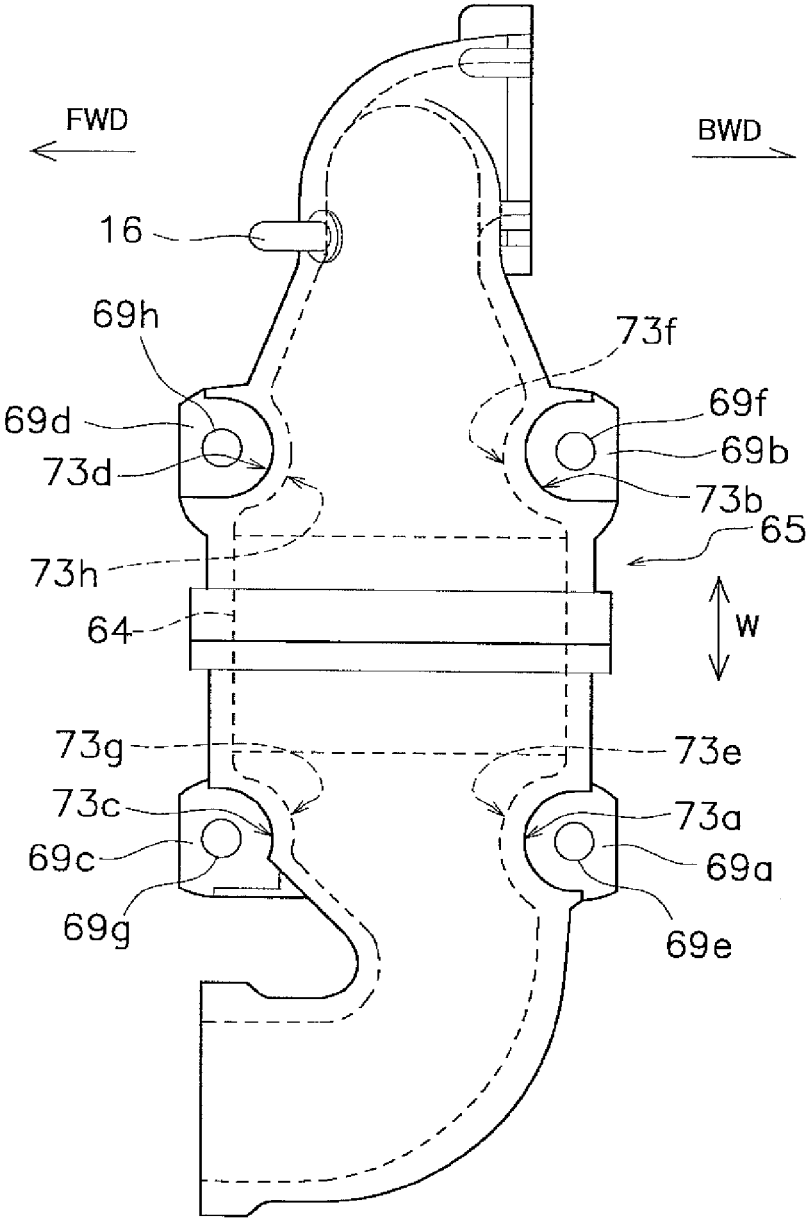
FIG. 10 is a plan view of the catalytic converter unit.
Figure 11:
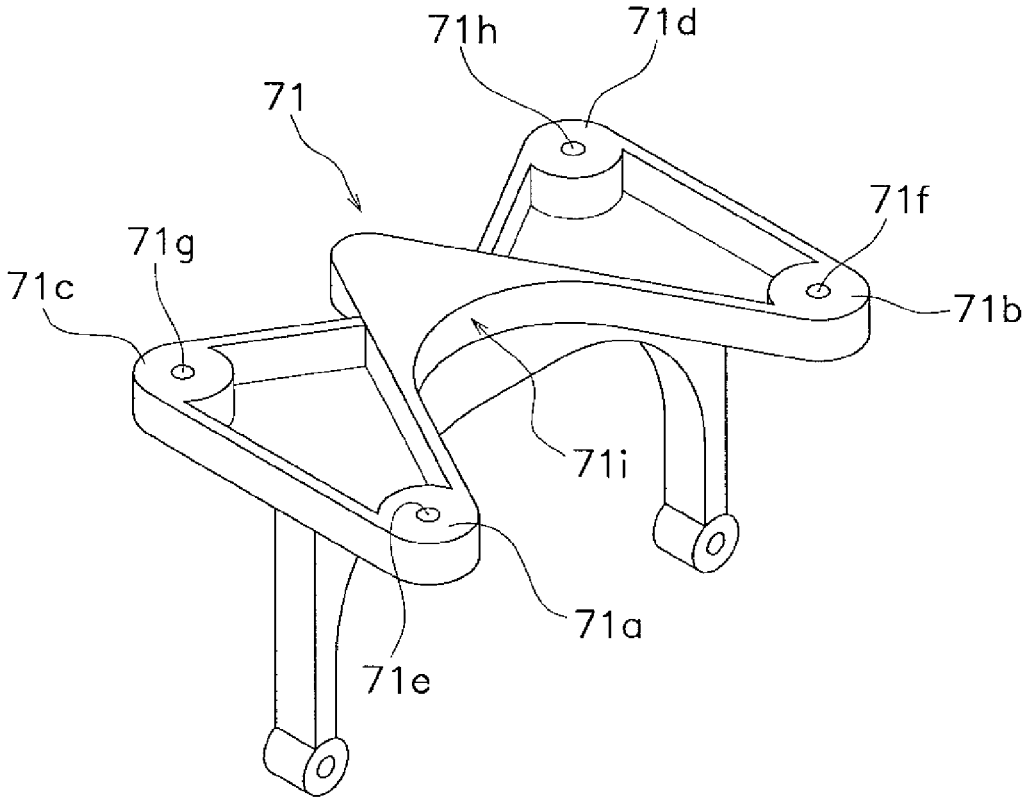
FIG. 11 is a perspective view of a support bracket.

The catalytic converter unit 42 is attached to the support bracket 71 through the first to fourth dampers 72*a* to 72*d*. The catalyst housing pipe 65 of the catalytic converter unit 42 includes first to fourth mounting sections 69*a* to 69*d* for attaching the catalyst housing pipe 65 to the support bracket 71. Each of the first to fourth mounting sections 69*a* to 69*d* has a plate-like shape. The first to fourth mounting sections 69*a* to 69*b* are arranged to correspond to the first to fourth dampers 72*a* to 72*d*. FIG. 10 is a plan view of the catalytic converter unit 42. As shown in FIG. 10, first to fourth mounting holes 69*e* to 69*h* are provided in the first to fourth mounting sections 69*a* to 69*d* such that the holes extend in a vertical direction. FIG. 11 is a perspective view of the support bracket 71. As shown in FIG. 11, the support bracket 71 includes first to fourth support sections 71*a* to 71*d*. The first to fourth support sections 71*a* to 71*d* are arranged to correspond to the first to fourth dampers 72*a* to 72*d*. Holes 71*e* to 71*h* each configured for a bolt to pass through are provided in the first to fourth support sections 71*a* to 71*d*. An upper surface of each of the first to fourth support sections 71*a* to 71*d* is flat to support the first to fourth dampers 72*a* to 72*d*.

Figure 12:
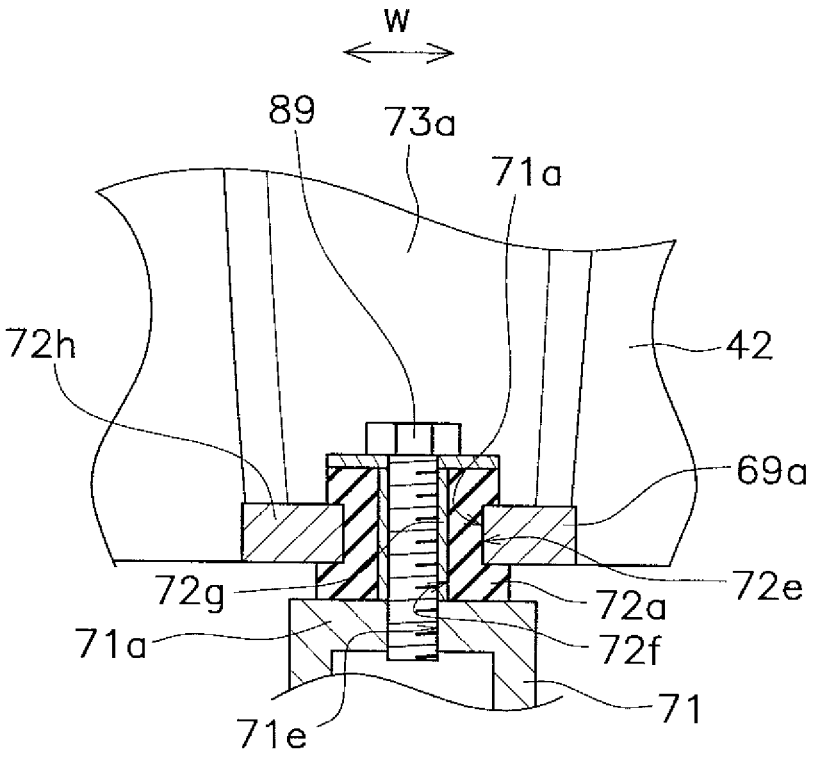
FIG. 12 is an enlarged sectional view showing a mounting structure between the catalytic converter unit and the support bracket.

FIG. 12 is an enlarged sectional view showing a mounting structure with which the catalytic converter 42 is attached to the support bracket 71 through the first damper 72*a*. The first damper 72*a* is installed into the first mounting hole 71*a* of the first mounting section 69*a*. The first damper 72*a* has a cylindrical shape. An annular groove 72*e* is provided in an outer circumferential surface of the first damper 72*a*. The groove 72*e* meshes with a rim portion of the first mounting hole 71*a*. A through hole 72*f* is provided in the first damper 72*a*. A metal collar 72*g* is fitted into the through hole 72*f*. A bolt 89 is inserted through the collar 72*g* and a washer 72*h* and screwed into the hole 71*e* of the first support section 71*a*. The mounting structure between the catalytic converter unit 42 and the support bracket 71 is the same at the second to fourth dampers 72*b* to 72*d* as at the first damper 72*a*. In this way, the catalytic converter unit 42 is attached to the support bracket 71 through the first to fourth dampers 72*a* to 72*d*.

As shown in FIGS. 2 to 6, the catalytic converter unit 42 is supported in a vertical direction by the damper section 72. Meanwhile, exhaust gas passes through the catalytic converter unit 42 in a horizontal direction. More specifically, exhaust gas passes through the catalytic converter unit 42 in the widthwise direction of the watercraft. Thus, the direction in which the catalytic converter unit 42 is supported by the damper section 72 is perpendicular to the direction in which exhaust gas passes through the catalytic converter unit 42.

As shown in FIG. 6 and FIG. 10, first to fourth recessed sections 73*a* to 73*d* are provided in an outer surface of the catalyst housing pipe 65 of the catalytic converter unit 42. The first to fourth recessed sections 73*a* to 73*d* are positioned above the first to fourth mounting sections 69*a* to 69*d*. Thus, the first to fourth recessed sections 73*a* to 73*d* are positioned above the first to fourth mounting holes 69*e* to 69*h*. The first to fourth recessed sections 73*a* to 73*d* are configured to recess in an inward direction of the catalyst housing pipe 65 from an outer surface of the catalyst housing pipe 65. The first to fourth recessed sections 73*a* to 73*d* are configured to extend upward from the first to fourth mounting sections 69*a* to 69*d*. As shown in FIG. 10, the inner surface of the catalyst housing pipe 65 includes first to fourth curved sections 73*e* to 73*h*. The first to fourth curved sections 73*e* to 73*h* are positioned on back sides of the first to fourth recessed sections 73*a* to 73*d*, respectively. The first to fourth curved sections 73*e* to 73*h* are curved such that they protrude in an inward direction of the catalyst housing pipe 65. The first curved section 73*e* and the third curved section 73*g* are positioned upstream of the catalyst member 64. The second curved section 73*f* and the fourth curved section 73*h* are positioned downstream of the catalyst member 64. The catalyst member 64 is positioned between the first curved section 73*e* and the second curved section 73*f* along a widthwise direction of the watercraft, i.e., in the direction in which exhaust gas passes. The catalyst member 64 is positioned between the third curved section 73*e* and the fourth curved section 73*h* along a widthwise direction of the watercraft, i.e., in the direction in which exhaust gas passes.

Figure 13:
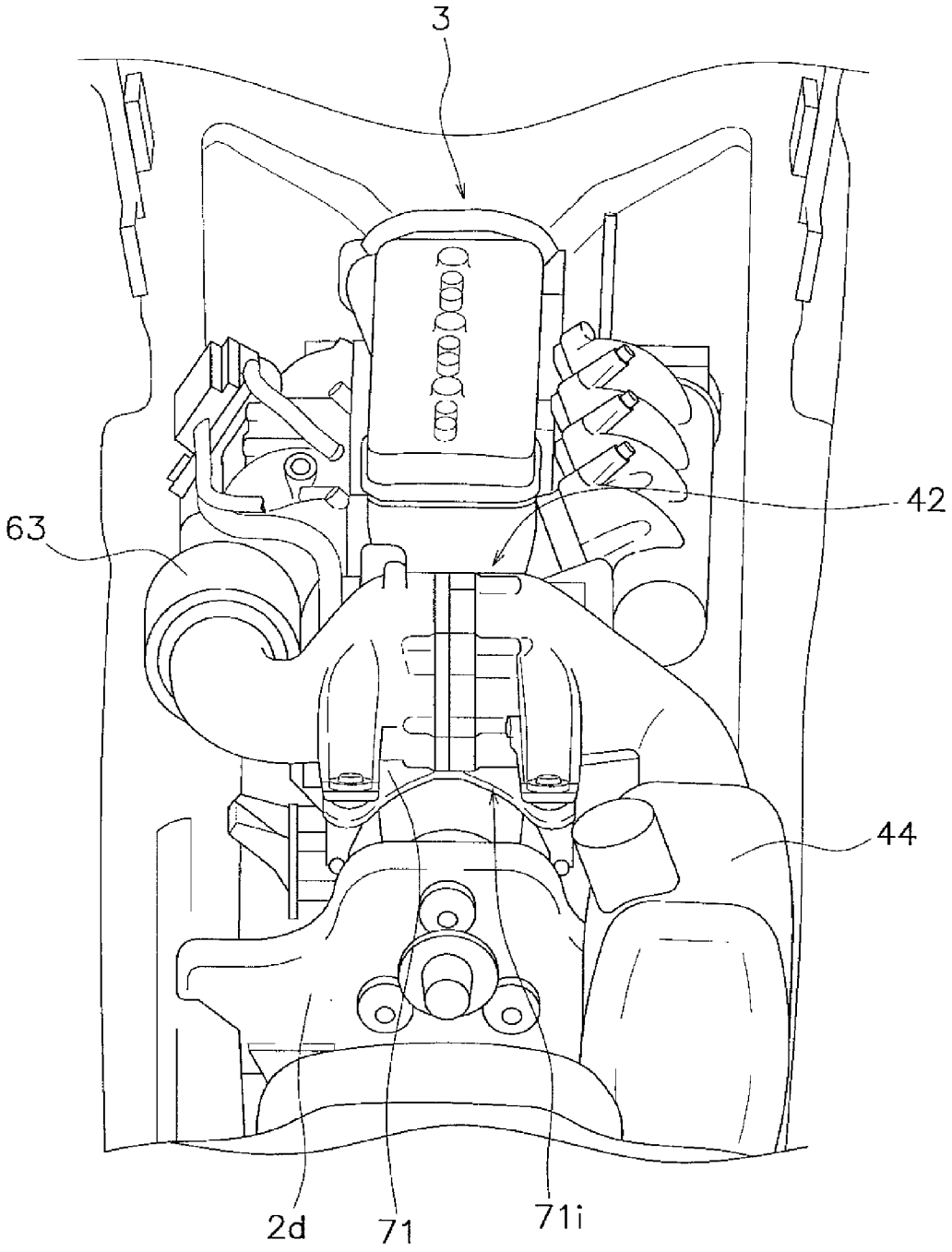
FIG. 13 shows the engine and a portion of the exhaust passage as viewed from above and behind.

As shown in FIG. 4, the support bracket 71 has a recessed shape at a portion positioned above the coupling section 33. More specifically, a recessed section 71*i* is provided in a rear portion of the support bracket 71. The recessed section 71*i* is configured to be recessed toward the engine 3 from the rear portion of the support bracket 71. As shown in FIG. 11, the recessed section 71*i* is positioned between the first support section 71*a* and the second support section 72*b*. As shown in FIG. 13, a position below the support bracket 71 can easily be seen when the engine 3 is viewed from a position above and rearward of the engine 3 or a position rearward of the engine 3.

As shown in FIG. 4, the second exhaust pipe 43 is arranged downstream of the catalytic converter unit 42. The second exhaust pipe 43 guides exhaust gas discharged from the engine 3. The second exhaust pipe 43 connects the catalytic converter unit 42 and the water lock 44 together. The second exhaust pipe 43 is positioned downstream of the catalyst housing pipe 65 and upstream of the water lock 44. The second exhaust pipe 43 is an example of the "second exhaust pipe" and the "second pipe section" according to a preferred embodiment of the present invention. The second exhaust pipe 43 is arranged to extend in the longitudinal direction of the watercraft. Thus, the axial centerline of the catalyst housing pipe 65 is not parallel to an axial centerline of the second exhaust pipe 43. The second exhaust pipe 43 includes a second connecting section 75 and a connecting pipe 76. A shown in FIG. 7, the second connecting section 75 is configured to curve toward the connecting pipe 76 and extend in the longitudinal direction of the watercraft. The second connecting section 75 is preferably made of aluminum or another metal. A water jacket section 68*d* is provided in the second connecting section 75. The water jacket section 68*d* of the second connecting section 75 communicates with the water jacket section 68*b* of the catalyst housing pipe 65. A downstream end portion of the second connecting section 75 is connected to the connecting pipe 76. The connecting pipe 76 connects the second connecting section 75 and the water lock 44 together.

Figure 14:
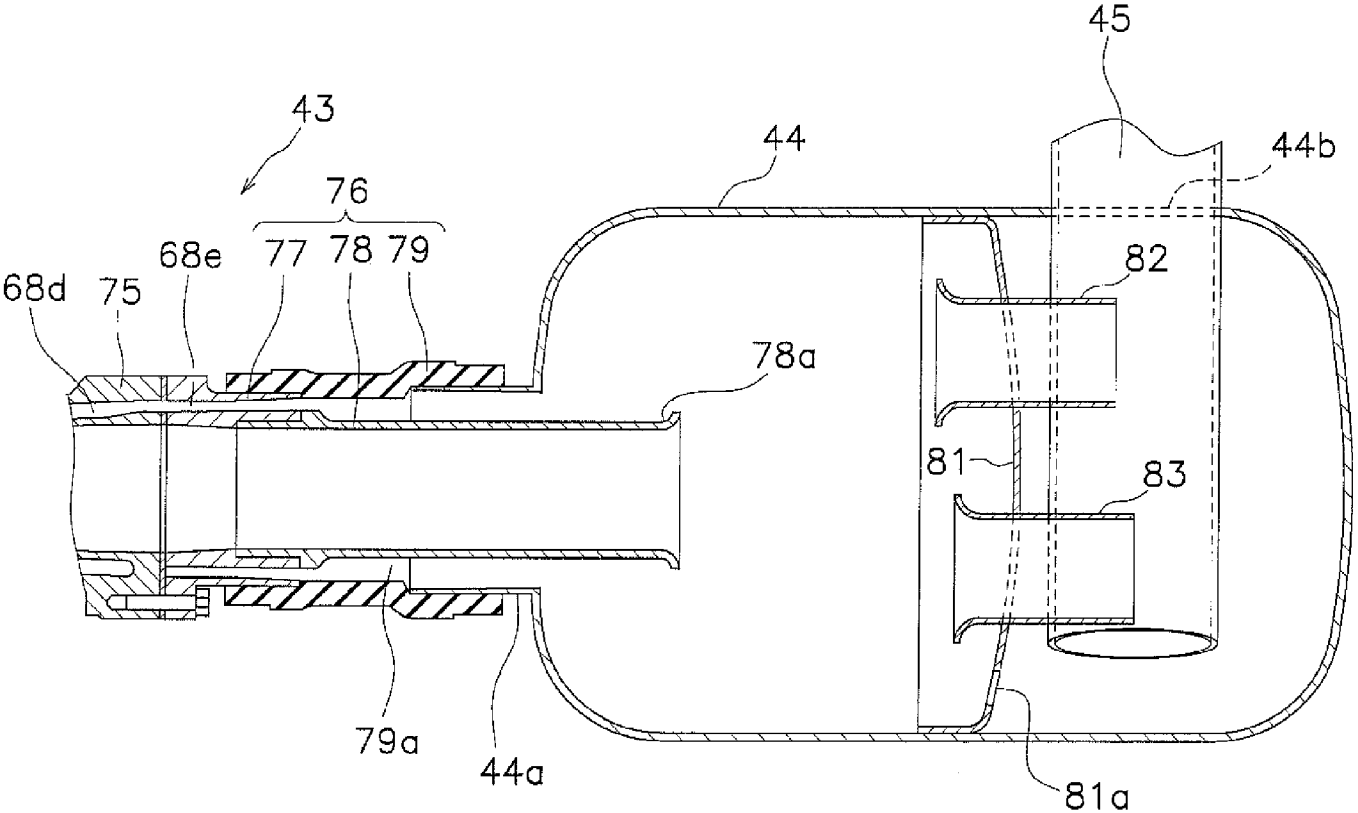
FIG. 14 a partial sectional view taken along a section line XIV-XIV of FIG. 4.

FIG. 14 is a partial sectional view taken along a section line XIV-XIV of FIG. 4. As shown in FIG. 14, the connecting pipe 76 includes a tailpipe 77, an inner pipe 78, and a second joint section 79. The tailpipe 77 is connected to a downstream end portion of the second connecting section 75. The tailpipe 77 is preferably made of aluminum or another metal. The tailpipe 77 is fastened to the second connecting section 75 with bolts or other fastening members. The tailpipe 77 is arranged to extend in the longitudinal direction of the watercraft. A water jacket section 68*e* is provided in the tailpipe 77. The water jacket section 68*e* of the tailpipe 77 communicates with the water jacket section 68*d* of the second connecting section 75.

The second joint section 79 is configured to extend toward the water lock 44 from a downstream end portion of an outer circumferential surface of the tailpipe 77. The second joint section 79 has a cylindrical shape and is preferably made of a flexible material, e.g., rubber. A downstream end portion of the tailpipe 77 is inserted into the second joint section 79. The second joint section 79 is thus connected to the tailpipe 77.

The inner pipe 78 is arranged inside the second joint section 79. The inner pipe 78 is arranged to extend into the water lock 44 from a downstream end portion of an inner circumferential surface of the second joint section 79. The inner pipe 78 is, for example, a cylindrical pipe preferably made of aluminum or another metal. A tip end portion (downstream end portion) of the inner pipe 78 forms a widened section 78*a* configured such that its diameter gradually increases toward the tip end. The widened section 78*a* has a smoothly curved bell mouth shape. An upstream end portion of the inner pipe 78 screws into an internal surface of a downstream end portion of the tailpipe 77. In this way, the inner pipe 78 is fixed to the tail pipe 77. The downstream end portion of the inner pipe 78 is positioned in the interior of the water lock 44.

An external diameter of the inner pipe 78 is smaller than an internal diameter of the second joint section 79. Consequently, a cooling water passage 79*a* is provided between an outer circumferential surface of the inner pipe 78 and an inner circumferential surface of the second joint section 79. The cooling water passage 79*a* communicates with the water jacket section 68*e* of the tailpipe 77. The cooling water passage 79*a* communicates with an internal space of the water lock 44. Thus, cooling water is mixed with exhaust gas in the water lock 44.

As shown in FIG. 7 and FIG. 14, a bottom portion of an inner surface of the second exhaust pipe 43 is configured such that there are no portions that slope upward in the downstream direction. More specifically, a bottom portion of an inner surface of the connecting pipe 76 is configured to extend horizontally toward the water lock 44.

The water lock 44 is arranged such that its lengthwise direction extends in the longitudinal direction of the watercraft. Thus, the axial centerline of the catalyst housing pipe 65 is not parallel to an axial centerline of the water lock 44. The water lock 44 is connected to a downstream end portion of the second exhaust pipe 43. Thus, the water lock 44 is arranged downstream of the catalyst member 64 in the exhaust passage 4. The water lock 44 is connected to the exhaust pipe 45 (see FIG. 1). A tip end of the exhaust pipe 45 is arranged outside the hull 2 and exhaust gas is discharged to the outside of the hull 2 from the exhaust pipe 45. Thus, the exhaust gas is discharged from the exhaust pipe 45 into the water. The water lock 44 is configured to prevent water that has entered the exhaust pipe 45 from flowing inward toward the engine 3. The water lock 44 is fixed to the hull 2. As shown in FIG. 2, a bottom portion of the water lock 44 is arranged lower than a bottom portion of the catalytic converter unit 42. As shown in FIG. 6, a widthwise dimension L1 of the water lock 44 is smaller than a vertical dimension L2 of the water lock 44.

As shown in FIG. 14, the water lock 44 preferably has the form of a sealed tank. A cylindrical connecting section 44*a* is provided on an upstream end portion of the water lock 44. The connecting section 44*a* is inserted into the second joint section 79. As a result, a downstream end portion of the second joint section 79 is connected to the connecting section 44*a*. The interior of the water lock 44 is partitioned into an upstream portion and a downstream portion by a partition 81. The partition 81 includes a plate-shaped member. The partition 81 is curved such that it bulges out in a downstream direction. A pair of partition pipes 82 and 83 is also arranged inside the water lock 44. The partition pipes 82 and 83 are arranged spaced apart in a vertical direction. The partition pipes 82 and 83 pass through the partition 81. A water drainage hole 81*a* is provided in a lower portion of the partition 81. Cooling water collected in the upstream portion of the interior of the water lock 44 drains to the downstream portion through the water drainage hole 81. Amounting hole 44*b* is provided in an upper surface of the water lock 44. An upstream end portion of the exhaust pipe 45 passes through the mounting hole 44*b* such that it is inserted into a downstream portion of the water lock 44. The upstream end portion of the exhaust pipe 45 extends to a position near a bottom portion of the water tank 44.

Figure 15:
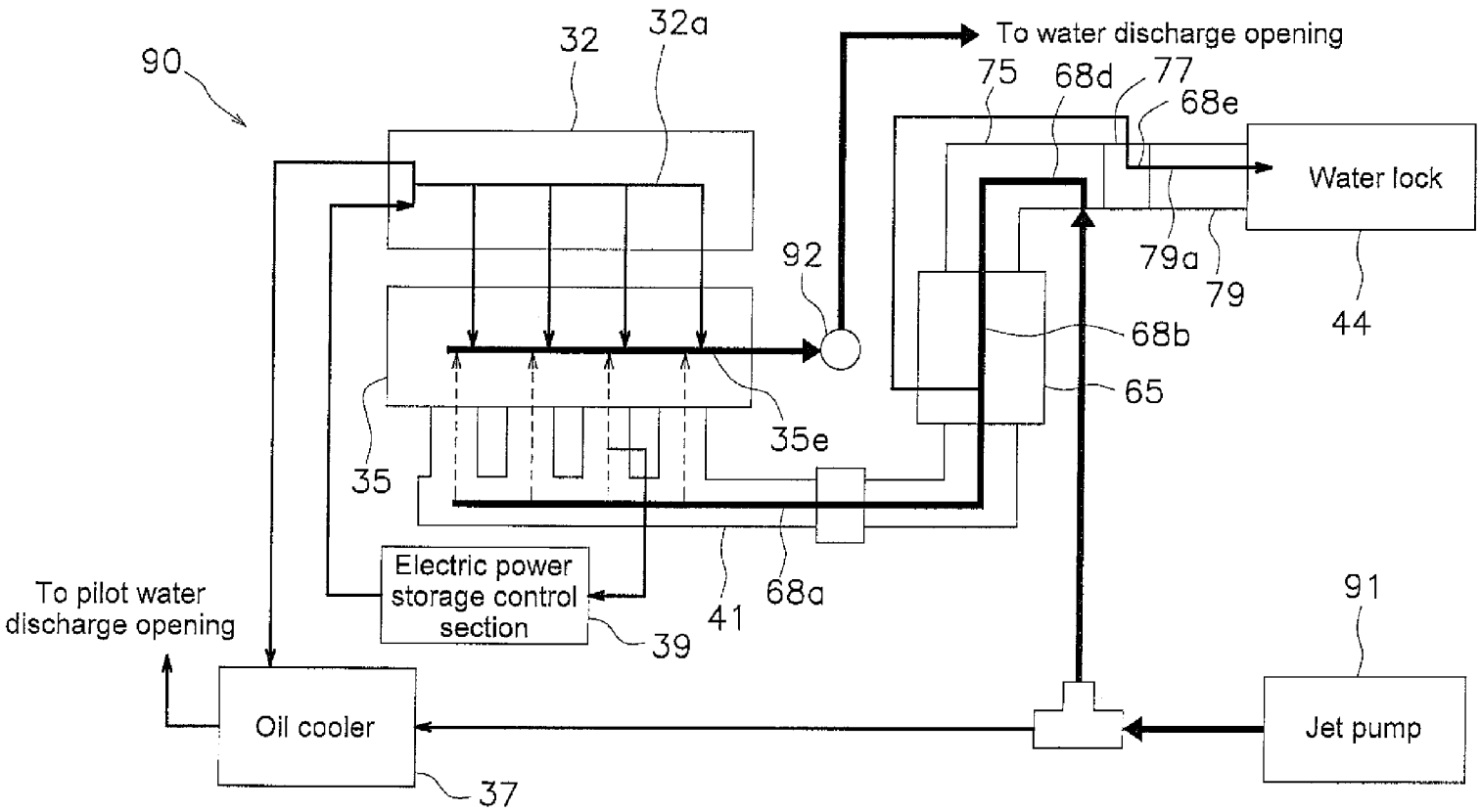
FIG. 15 is a diagram showing an arrangement of a cooling water passage.

FIG. 15 is a diagram showing a cooling water path 90 of the water jet propulsion watercraft 1. The cooling water path 90 includes the water flow channels 35*e* of the cylinder head 35, the water jacket section 68*a* of the first exhaust pipe 41, the water jacket section 68*b* of the catalyst housing pipe 65, the water jacket section 68*c* (see FIG. 9) of the catalyst member 64, the water jacket section 68*d* of the second connecting section 75, the water jacket section 68*e* of the tail pipe 77, and the cooling water passage 79*a* inside the second joint section 79.

Cooling water discharged from the jet pump 91 is directed to the water jacket section 68*d* of the second connecting section 75. The cooling water flows sequentially through the water jacket section 68*d* of the second connecting section 75, the water jacket section 68*b* of the catalyst housing pipe 65, and the water jacket section 68*a* of the first exhaust pipe 41 in order as listed. The cooling water flows from the water jacket section 68*a* of the first exhaust pipe 41 to the water flow channels 35*e* of the cylinder head 35. Also, a portion of the cooling water in the water jacket section 68*a* of the first exhaust pipe 41 flows to the electric power storage control device 39. From the electric power storage control device 39, the cooling water passes through a water flow channel 32*a* of the crankcase 32 and into the water channels 35*e* of the cylinder head 35. From the water flow channels 35*e* of the cylinder head 35, the cooling water passes through a thermostat 92 and flows to a water discharge opening (not shown). The cooling water is discharged from the water discharge opening to the water outside the hull. The thermostat 92 is configured to open a flow path of the cooling water when a temperature of the cooling water is equal to or above a prescribed temperature and close the flow path when the temperature of the cooling water is lower than the prescribed temperature. In this way, the thermostat 92 executes a temperature control of the cooling water.

A portion of the cooling water in the water jacket section 68*b* of the catalyst housing pipe 65 is also sent to the water jacket section 68*e* of the tail pipe 77, from which the cooling water passes through the cooling water passage 79*a* of the second joint section 79 and into the water lock 44. A portion of the cooling water discharged from the jet pump 91 is fed to the oil cooler 37. Additionally, a portion of the cooling water in the water flow channel 32*a* of the crankcase 32 is also fed to the oil cooler 37. Cooling water flows from the oil cooler 37 to a pilot water discharge opening (not shown) From the pilot water discharge opening, the cooling water is discharged to the exterior of the water jet propulsion watercraft 1.

The first exhaust pipe 41 connects to the catalytic converter unit 42, and the catalytic converter unit 42 is arranged to face a rear surface of the engine 3. As a result, a passage length of the exhaust passage 4 is shorter between the first to fourth exhaust ports 35*a* to 35*d* of the engine 3 and the catalytic converter unit 42. As a result, high-temperature exhaust gas can be delivered to the catalytic converter unit 42 and, thus, the catalytic converter unit 42 can be activated quickly after the engine 3 is started. In this way, harmful components (e.g., HC, CO, and NOx) contained in the exhaust gas can be reacted sufficiently in the catalytic converter unit 42 and the exhaust gas can be cleaned in an efficient manner.

In the exhaust passage 4, the first oxygen sensor 15 is arranged upstream of the catalyst member 64. The second oxygen sensor 16 is arranged downstream of the catalyst member 64. Consequently, it is possible to monitor whether the catalytic converter is functioning effectively by comparing a detection result obtained from the first oxygen sensor 15 to a detection result obtained from the second oxygen sensor 16. The second oxygen sensor 16 is arranged upstream of the water lock 44. Consequently, second oxygen sensor 16 can be prevented from getting wet due to water that has backwashed into the exhaust passage 4. Thus, the reliability of monitoring achieved with the first oxygen sensor 15 and the second oxygen sensor 16 can be improved.

In a cross-section perpendicular to an axial centerline of the catalyst housing pipe 65, the second oxygen sensor 16 is arranged higher than the longitudinally oriented centerline C2 in the longitudinal direction and closer to the engine 3 than the vertically oriented centerline C3. Thus, the second oxygen sensor 16 is arranged to protrude toward the engine 3 from the catalyst housing pipe 65. As a result, the second oxygen sensor 16 can be arranged more compactly between the catalyst housing pipe 65 and the engine 3.

The catalyst housing pipe 65 in which the second oxygen sensor 16 is installed is not parallel to the axial centerline of the water lock 44 or to the second exhaust pipe 43. Consequently, even if water backflows from the exhaust pipe 45, the water does not easily reach the catalyst housing pipe 65. As a result, the second oxygen sensor 16 can be prevented from getting wet.

The second oxygen sensor 16 is arranged in the decreasing diameter section 65*c* of the catalyst housing pipe 65. The second oxygen sensor 16 can detect an oxygen concentration with respect to the exhaust gas that is mixed in the decreasing diameter section 65*c*. As a result, the precision with which the second oxygen sensor 16 detects the oxygen concentration can be improved.

The first oxygen sensor 15 is installed in the collector pipe 61*e* in a position downstream of the fourth connection opening 61*i*. Since the fourth connection opening 61*i* is positioned the farthest downstream among the first to fourth connection openings 61*f* to 61*i*, the first oxygen sensor 15 can detect an oxygen concentration with respect to exhaust gas that has passed through the first to fourth connection openings 61*f* to 61*i* and collected in the collector pipe 61*e*. Thus, even if there is variation in the oxygen concentrations of the exhaust gases entering from each of the first to fourth connection openings 61*f* to 61*i*, the oxygen concentration can be detected with good precision.

The first oxygen sensor 15 is positioned upstream of the first joint section 63 in the first exhaust pipe 41. Thus, the passage length of the exhaust passage 4 from the engine 3 to the first oxygen sensor 15 is short. Consequently, the first oxygen sensor 15 can be held at a high temperature due to the high-temperature exhaust gas and the first oxygen sensor 15 can be activated in a satisfactory manner.

The exhaust manifold 61 is fixed directly to the engine 3. Meanwhile, the first connecting section 62 is positioned downstream of the first joint section 63. The first joint section 63 is arranged between the engine 3 and the first connecting section 62. Consequently, heat from the engine 3 is not readily transferred to the first connecting section 62. In particular, if the first joint section 63 is preferably made of rubber, then heat from the engine 3 will not be readily transferred to the first connecting section 62 because the thermal conductivity of the first joint section 63 will be poor. Consequently, the exhaust manifold 61 will become hotter than the first connecting section 62. Thus, by installing the first oxygen sensor 15 in the exhaust manifold 61, the first oxygen sensor 15 can be activated satisfactorily.

The bottom portions of the internal surfaces of the first exhaust pipe 41, the catalyst housing pipe 65, and the second exhaust pipe 43 are configured such there are no portions that slope upward in the downstream direction. As a result, even if water condensation occurs in the first exhaust pipe 41, the catalyst housing pipe 65, and the second exhaust pipe 43, the condensed water can be prevented from flowing toward the engine 3.

The water jacket section 68*a* of the first exhaust pipe 41 is positioned farther downstream along the cooling water path 90 than the water jacket section 68*b* of the catalyst housing pipe 65. Thus, the cooling water flowing to the exhaust manifold 61 of the first exhaust pipe 41 has passed through the catalytic converter unit 42 and does not have an excessively low temperature. Consequently, the occurrence of condensation in the exhaust manifold 61 can be prevented. As a result, the first oxygen sensor 15 is prevented from getting wet.

Although a preferred embodiment of the present invention has been described above, the present invention is not limited to the preferred embodiment described above. Various changes can be made without departing from the scope of the present invention.

Figure 16:
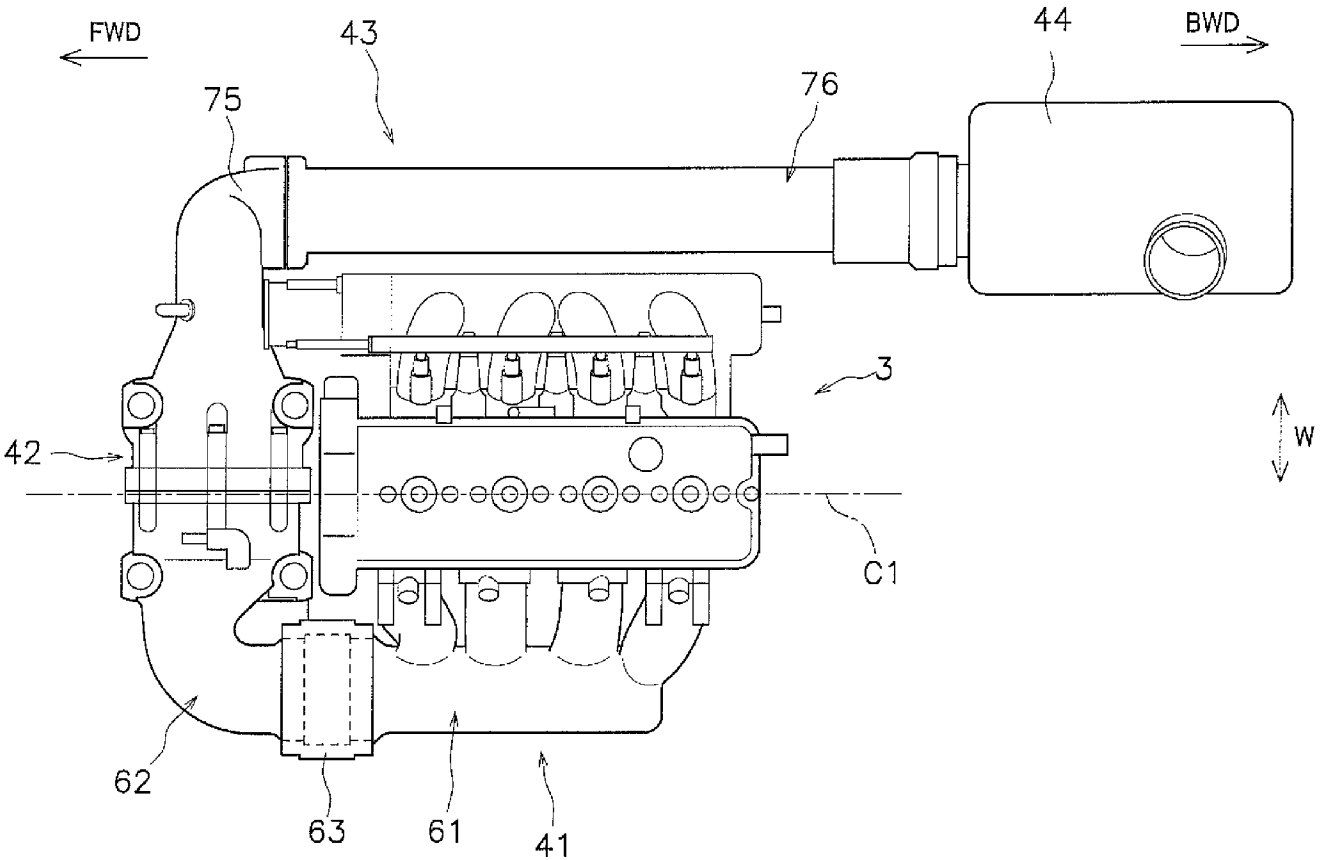
FIG. 16 is a plan view showing an engine and a portion of an exhaust passage according to another preferred embodiment of the present invention.

Although the catalytic converter unit 42 preferably is arranged to face a rear surface of the engine 3 in the previously explained preferred embodiment, the present invention is not limited to arranging the catalytic converter unit 42 in such a position. For example, as shown in FIG. 16, it is acceptable to arrange the catalytic converter unit 42 along a front surface of the engine 3. It is also acceptable to arrange the catalytic converter unit 42 along a side surface of the engine 3. The number of dampers is not limited to four as presented in the previously explained preferred embodiment. A number smaller than four or a number larger than four is also acceptable. The number of exhaust ports is not limited to four as presented in the previously explained preferred embodiment. A number smaller than four or a number larger than four is also acceptable.

Figure 17:
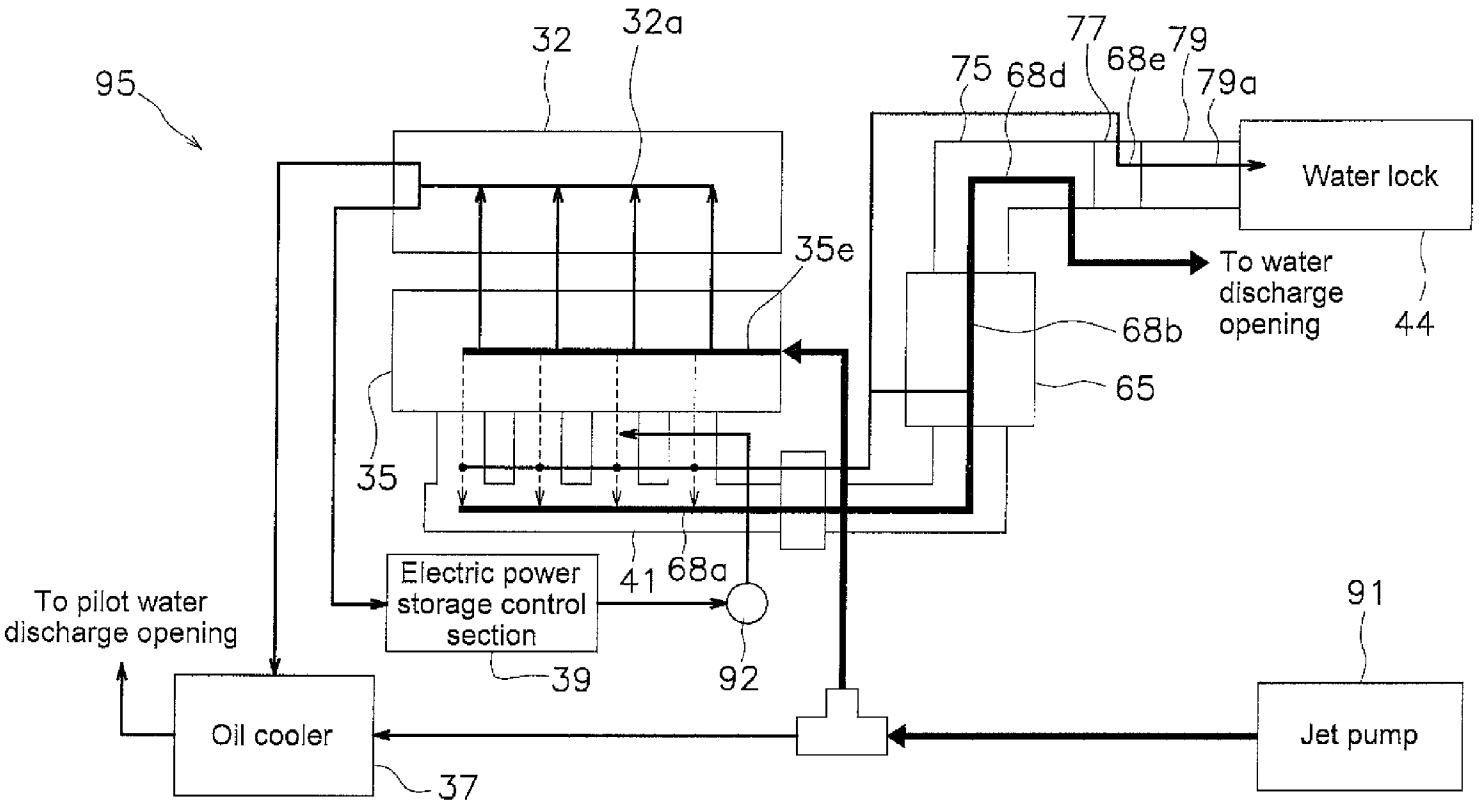
FIG. 17 is a diagram showing an arrangement of a cooling water passage according to another preferred embodiment of the present invention.

The cooling water path is not limited to the configuration presented in the previously explained preferred embodiment. For example, it is acceptable for the water jet propulsion watercraft to be provided with a cooling water path 95 like that shown in FIG. 17. In this alternative configuration, cooling water discharged from the jet pump 91 is fed to the water flow channels 35*e* of the cylinder head 35. From the water flow channels 35*e* of the cylinder head 35, the cooling water flows sequentially to the water jacket section 68*a* of the first exhaust pipe 41, the water jacket section 68*b* of the catalyst housing pipe 65, and the water jacket section 68*d* of the second connecting section 75 in order as listed. The cooling water then flows from the water jacket section 68*d* of the second connecting section 75 to a water discharge opening (not shown). The cooling water is discharged from the water discharge opening to the outside water. A portion of the cooling water in the water flow channels 35*e* of the cylinder head 35 flow through the water flow channel 32*a* of the crankcase 32 and to the electric power storage control device 39. The cooling water exiting the electric power storage control device 39 passes through the thermostat 92 and flows to the water jacket section 68*a* of the first exhaust pipe 41. A portion of the cooling water from the water jacket section 68*a* of the first exhaust pipe 41 and a portion of the cooling water from the water jacket section 68*b* of the catalyst housing pipe 65 merge and flow to the water jacket section 68*e* of the tailpipe 77. From the water jacket section 68*e* of the tail pipe 77, the cooling water passes through the water flow passage 79*a* inside the second joint section 79 and into the water lock 44. A portion of the cooling water discharged from the jet pump 91 is fed to the oil cooler 37. A portion of the cooling water in the water flow channel 32*a* of the crankcase 32 is fed to the oil cooler 37. Cooling water flows from the oil cooler 37 to a pilot water discharge opening (not shown). From the pilot water discharge opening, the cooling water is discharged to the exterior of the water jet propulsion watercraft 1. In the cooling water path 95, the water jacket section 68*a* of the first exhaust pipe 41 is positioned downstream of the water flow passages 35*e* of the cylinder head 35. The cooling water flowing to the exhaust manifold 61 has passed through the cylinder head 35 and does not have an excessively low temperature. Consequently, the occurrence of condensation in the exhaust manifold 61 can be prevented. As a result, the first oxygen sensor 15 is prevented from getting wet.

It is acceptable for the second oxygen sensor 16 to be arranged in the exhaust passage 4 at a position downstream of the decreasing diameter section 65*c* of the catalyst housing pipe 65. For example, it is acceptable for the second oxygen sensor 16 to be arranged in the sloped section 70*b* of the catalyst housing pipe 65.

Figure 18:
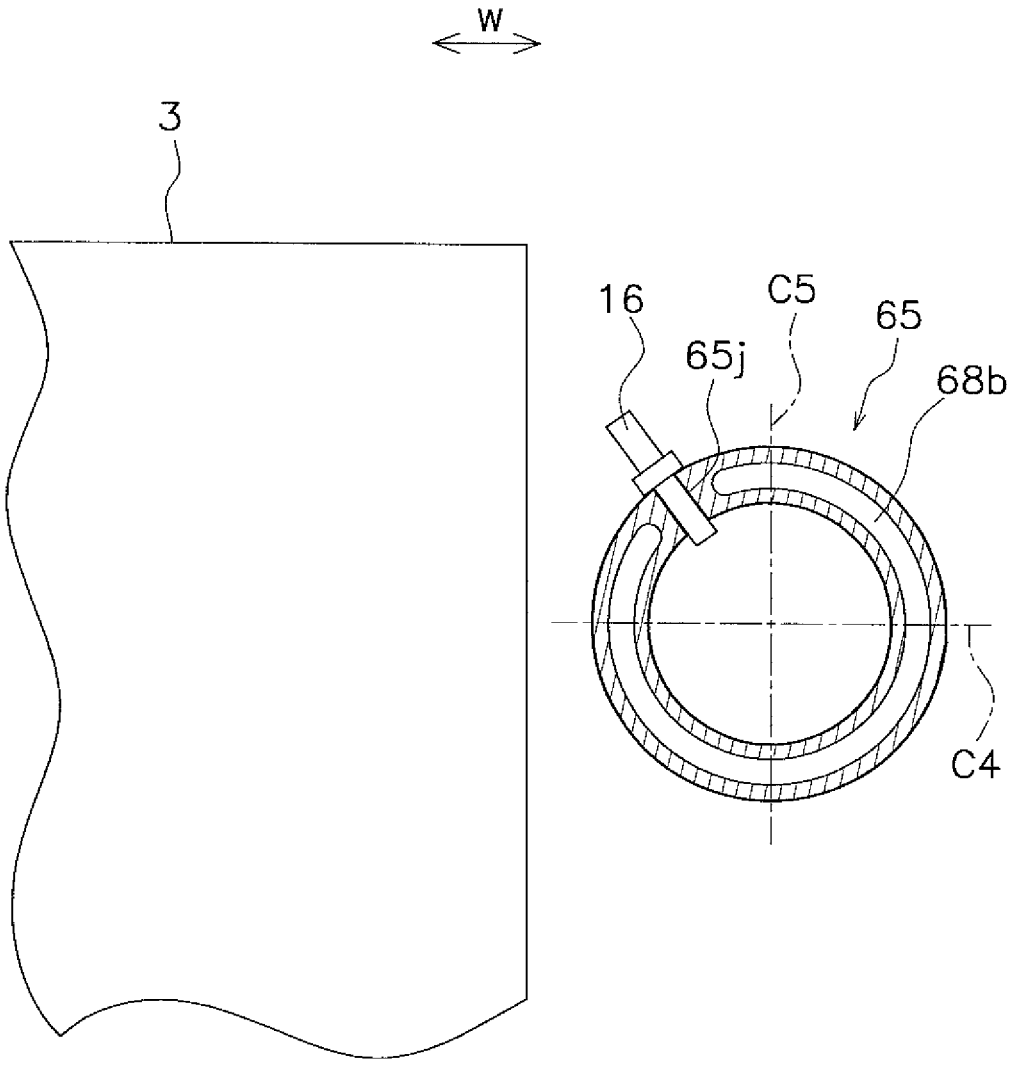
FIG. 18 is a schematic view showing the engine and a sectional view of a catalyst housing pipe according to another preferred embodiment of the present invention.

It is acceptable for the catalyst housing pipe 65 to be arranged to one side of the engine 3. In such a case, as shown in FIG. 18, in a cross-section perpendicular to an axial centerline of the catalyst housing pipe 65, the second oxygen sensor 16 is preferably arranged higher than a widthwise oriented centerline C4 and closer to the engine 3 in a widthwise direction than a vertically oriented centerline C5.

Similarly to the second oxygen sensor 16, it is acceptable the first oxygen sensor 15 to be higher than a widthwise oriented centerline and closer to the engine 3 in a widthwise direction than a vertically oriented centerline in a cross-section perpendicular to an axial centerline of the first exhaust pipe 41. It is also acceptable for the first exhaust pipe 41 to be arranged along a front surface or a rear surface of the engine 3. In such a case, it is acceptable for the first oxygen sensor 15 to be arranged higher than a longitudinally oriented centerline in the longitudinal direction and closer to the engine 3 than a vertically oriented centerline when viewed in a cross-section perpendicular to an axial centerline of the exhaust manifold 61.

It is acceptable for the first oxygen sensor 15 to be positioned in a region including the fourth connection opening 61*i*. It is also acceptable for the first oxygen sensor 15 to be positioned in a region including any of the first to third connection openings 61*f* to 61*h*. Furthermore, it is acceptable if the first oxygen sensor 15 is arranged in one of the first to fourth branch pipes 61*a* to 61*d*.

In the previously explained preferred embodiment, the first to fourth branch pipes 61*a* to 61*d* are preferably configured to extend laterally and downward from the first to fourth exhaust ports 35*a* to 35*d*. However, it is also acceptable for the branch pipes to be configured to extend horizontally from the exhaust ports.

Figure 19:
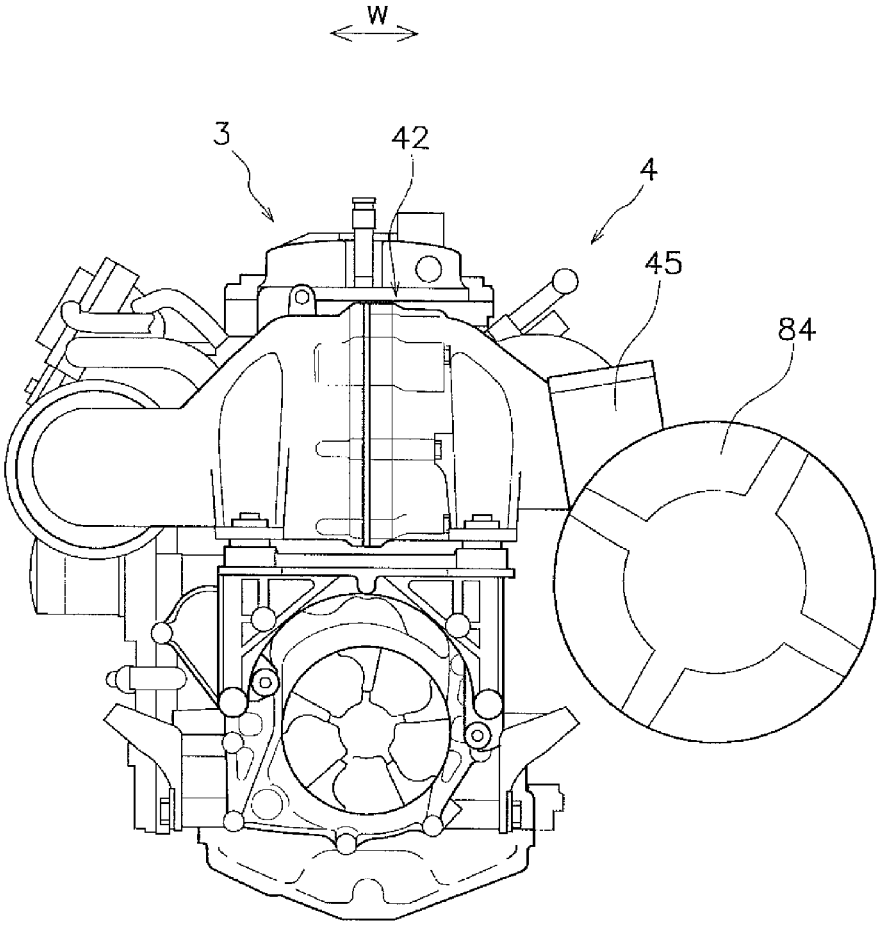
FIG. 19 is a rear view of water lock according to another preferred embodiment of the present invention.
Figure 20A:
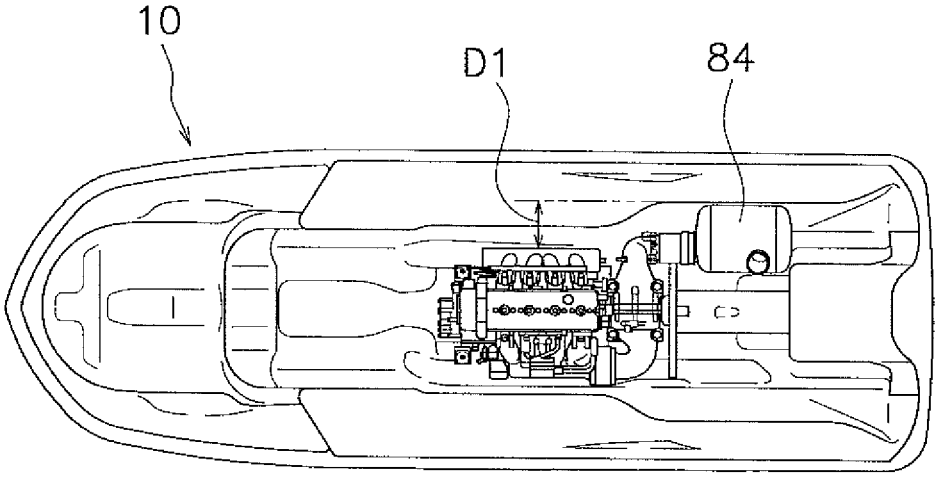
FIGS. 20A and 20B are plan views showing an arrangement of a water lock in a water jet propulsion watercraft according to the first preferred embodiment and an arrangement of the same according to another preferred embodiment of the present invention.
Figure 20B:
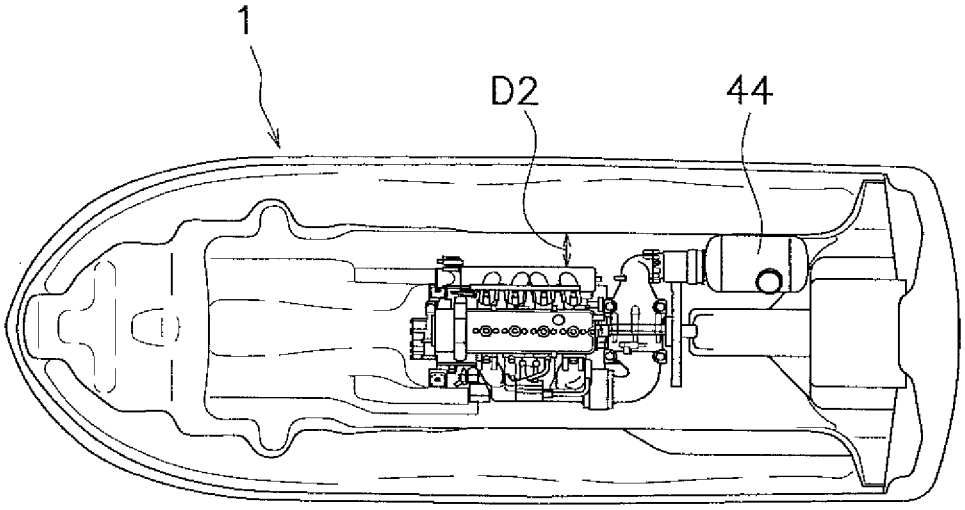

The shape of the water lock is not limited to the shape presented in the previously explained preferred embodiment. For example, it is acceptable to have a cylindrical water lock 84, as shown in FIG. 19. However, when the widthwise dimension L1 of the water lock 44 is smaller than the vertical dimension L2, the water lock 44 can be configured to have a smaller widthwise dimension L1 than a cylindrical water lock 84 of the same volume. FIG. 20A is a plan view of a water jet propulsion watercraft 10 including the cylindrical water lock 84. FIG. 20B is a plan view of a water jet propulsion watercraft 1 including the water lock 44 that is the same as in the previously explained preferred embodiment. As shown in FIGS. 20B and 20A, a distance D2 by which the water lock 44 according to the previously explained preferred embodiment protrudes beyond the engine 3 in a widthwise direction is preferably smaller than a distance D1 by which the cylindrical water lock 84 protrudes beyond the engine 3 in a widthwise direction. Thus, the water lock 44 according to the previously explained preferred embodiment enables a widthwise footprint of the exhaust system to be reduced.

Figure 21:
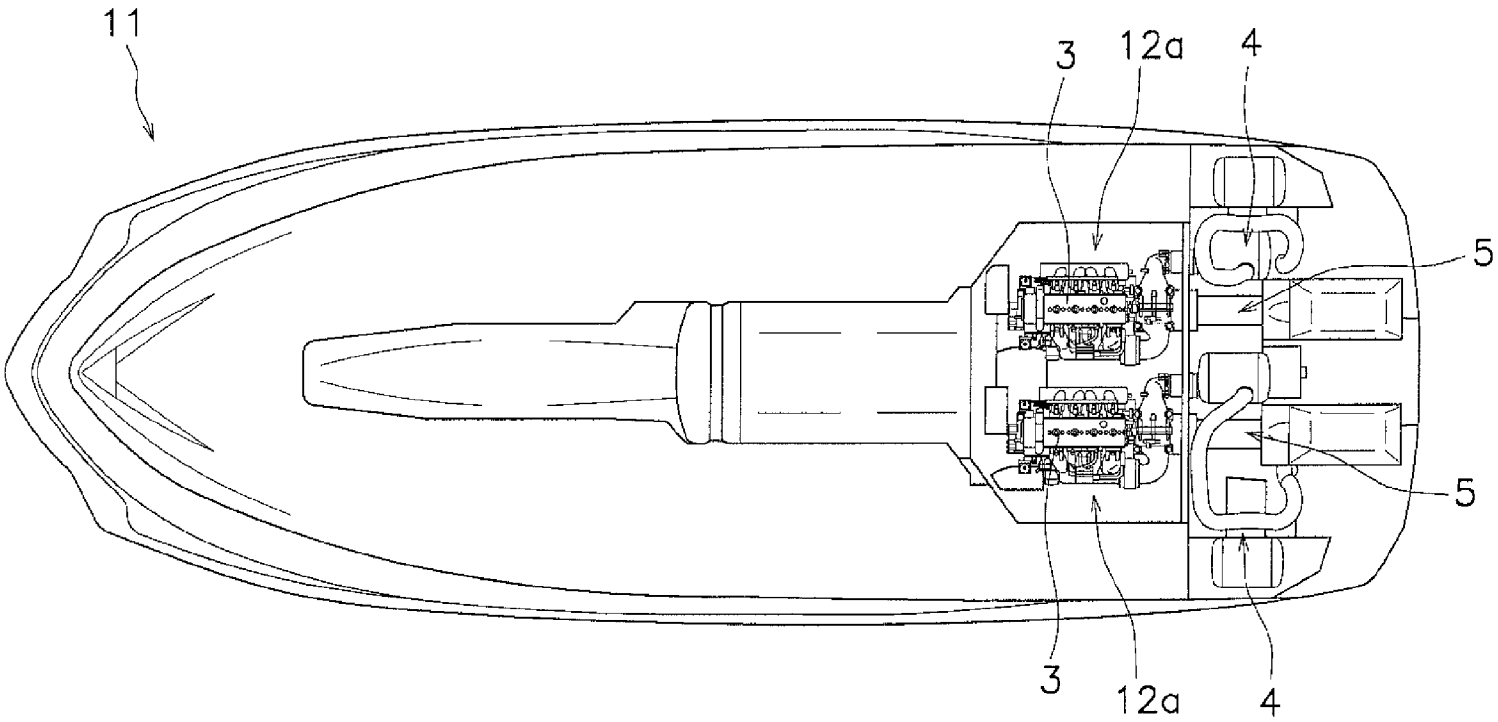
FIG. 21 is a plan view of a hull interior of a water jet propulsion watercraft according to another preferred embodiment of the present invention.

Although the water jet propulsion watercraft 1 in the previously explained preferred embodiment preferably is a personal watercraft, it is acceptable for the water jet propulsion watercraft to be a sport boat. For example, the water jet propulsion watercraft 11 shown in FIG. 21 is a sport boat equipped with a plurality of drive devices 12*a* and 12*b*. The drive devices 12*a* and 12*b* are each equipped with an engine 3, an exhaust passage 4, and a jet propulsion unit 5 similar to those presented in the previously explained preferred embodiment.

Figure 22:
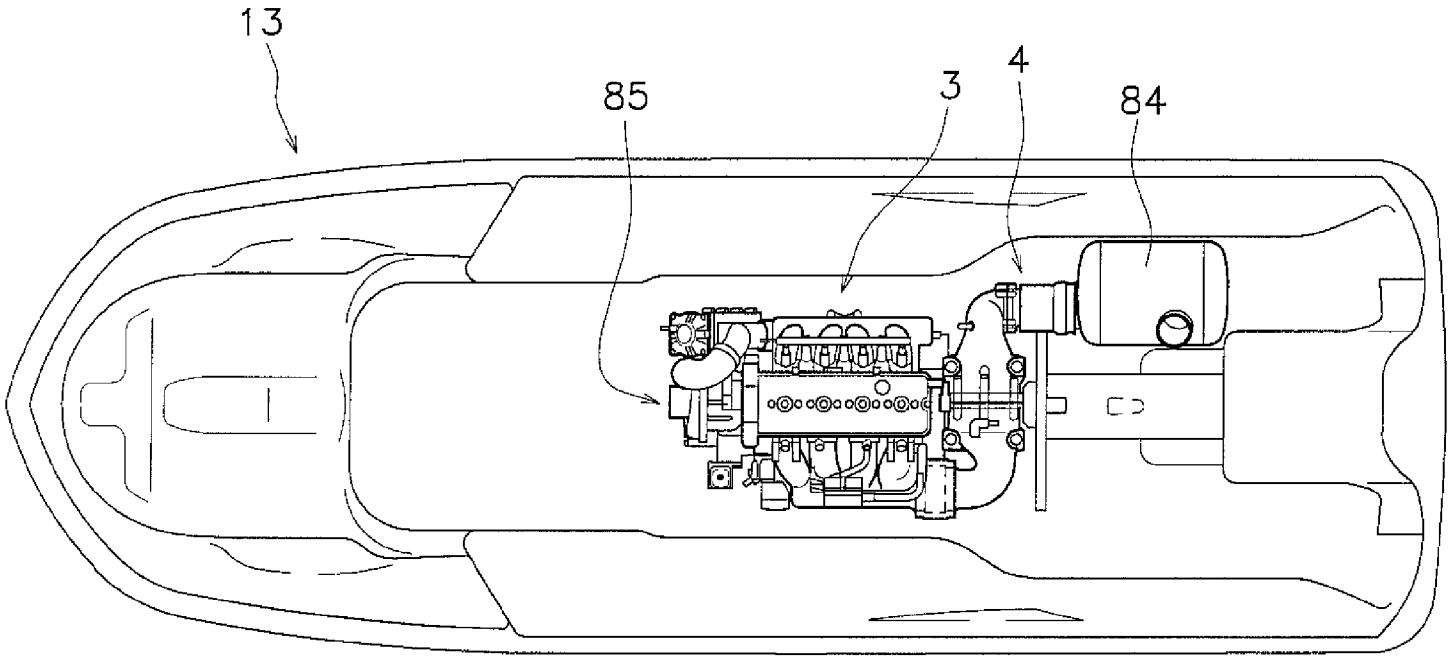
FIG. 22 is a plan view of a hull interior of a water jet propulsion watercraft according to another preferred embodiment of the present invention.
Figure 23:
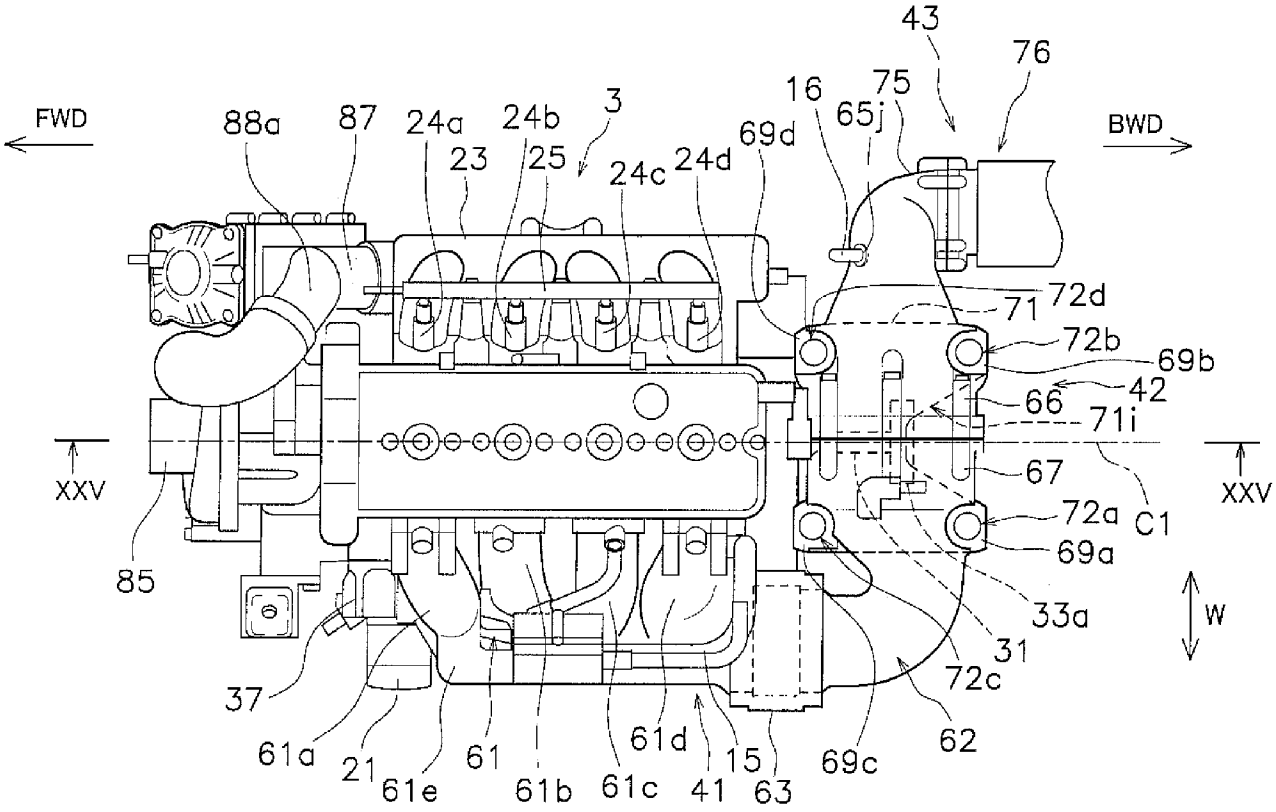
FIG. 23 is a plan view showing an engine and a portion of an exhaust passage in a water jet propulsion watercraft according to another preferred embodiment of the present invention.
Figure 24:
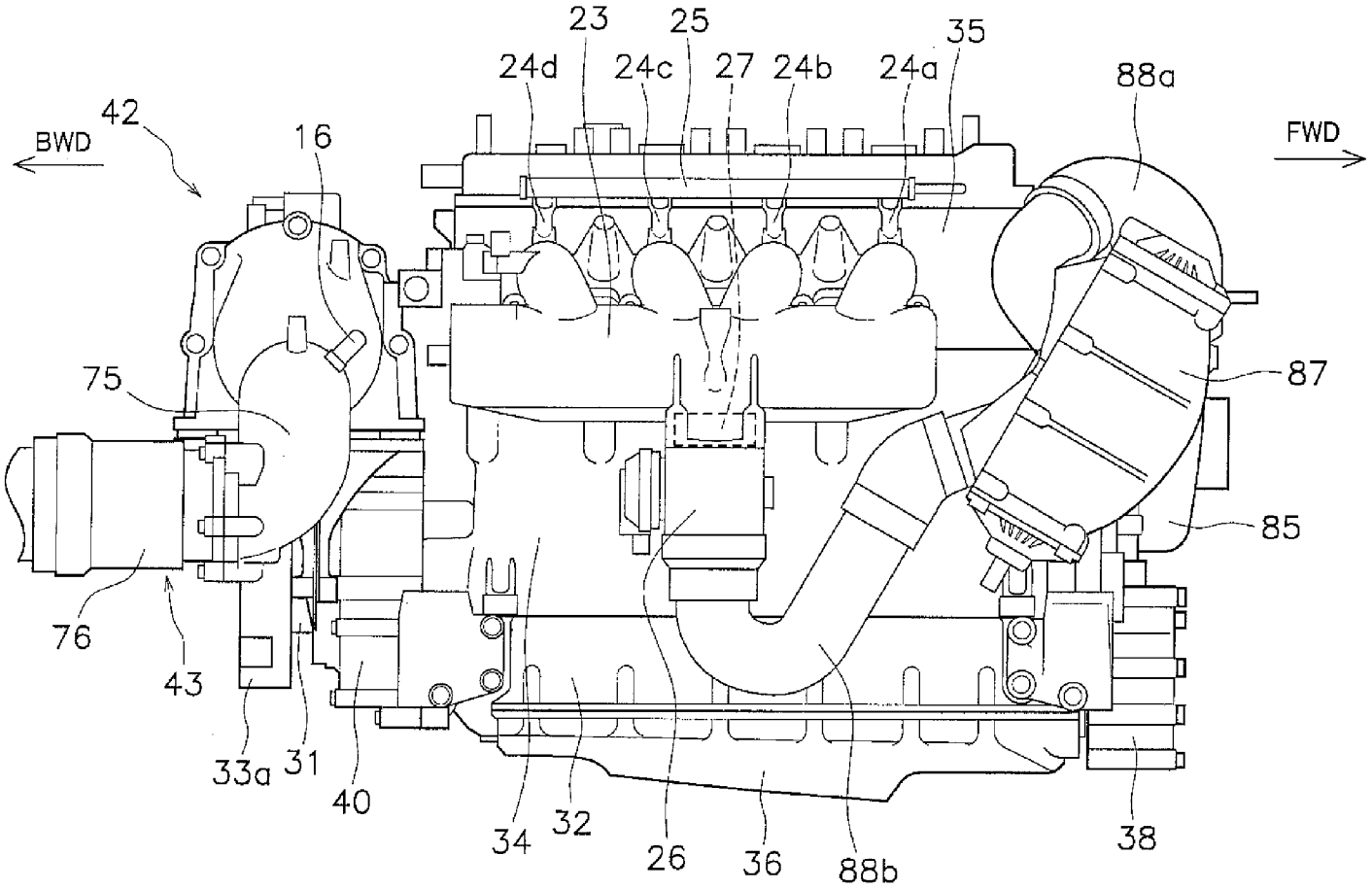
FIG. 24 is a right side view of an engine.
Figure 25:
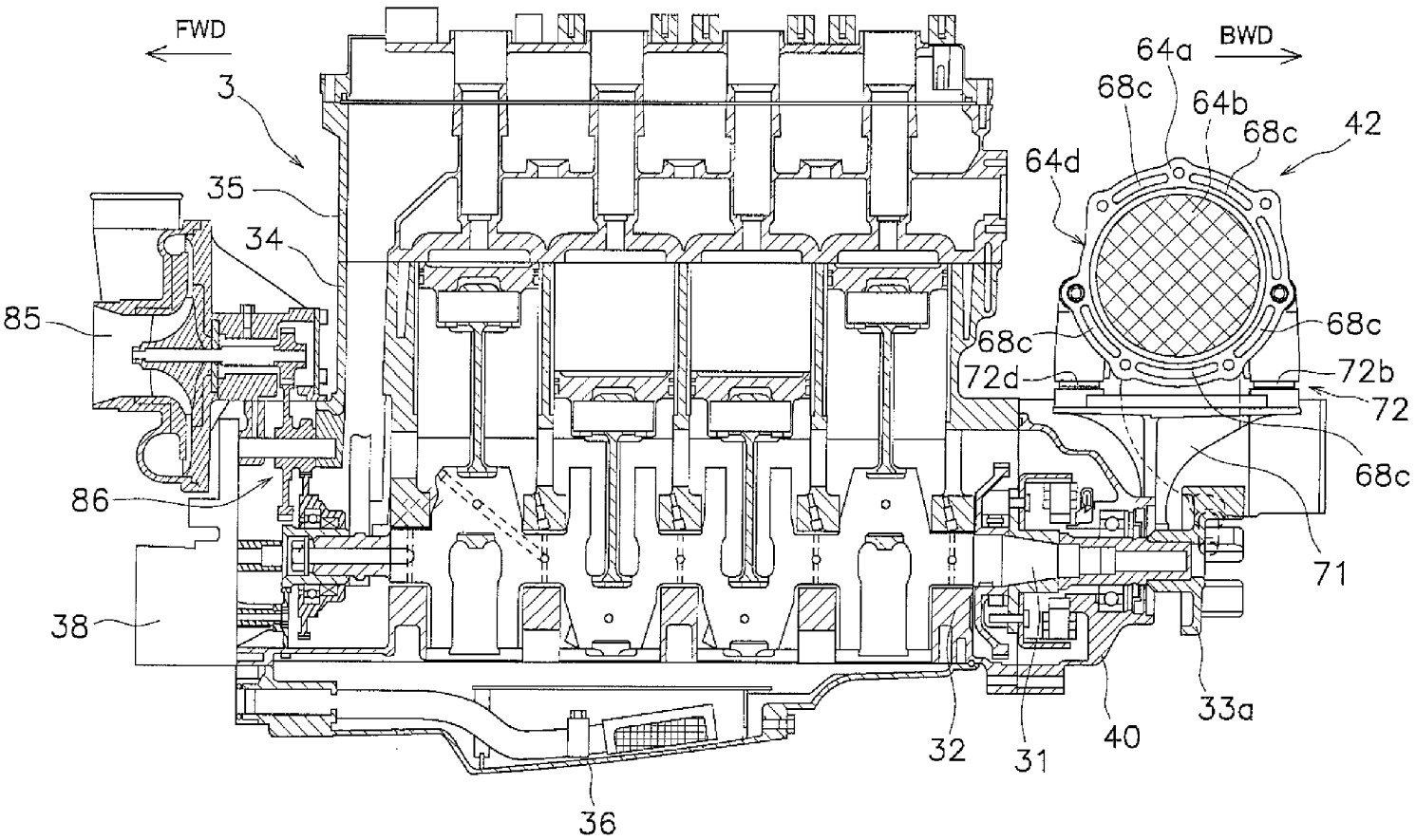
FIG. 25 is a sectional view taken along a section line XXV-XXV of FIG. 23.

Although the engine 3 presented in the previously explained preferred embodiment preferably is a naturally aspirated engine, it is also acceptable for the engine 3 to be equipped with a supercharger 85, as in the water jet propulsion watercraft 13 shown in FIG. 22. FIG. 22 is a plan view of a hull interior of the water jet propulsion watercraft 13. FIG. 23 is a plan view of the engine 3 and a portion of the exhaust passage 4 of the water jet propulsion watercraft 13. FIG. 24 is a right-hand side view of the engine 3. FIG. 25 is a sectional view taken along a section line XXV-XXV of FIG. 23. As shown in FIG. 23, the supercharger 85 is arranged in front of the engine 3. Thus, the engine 3 is arranged between the supercharger 85 and the catalytic converter unit 42. The supercharger 85 serves to compress air supplied to the engine 3. As shown in FIG. 25, rotation of the crankshaft 31 is transmitted to the supercharger 85 through a gear mechanism 86 that is connected to a forward portion of the crankshaft 31. The supercharger 85 is driven by this transfer of rotation. As shown in FIG. 24, an air cooler 87 is arranged in forward portion of the right side of the engine 3. The air cooler 87 is connected to the supercharger 85 through a first air induction pipe 88*a*, and the air cooler 87 serves to cool the air compressed by the supercharger 85. The air cooler 87 is connected to the throttle body 26 through a second air induction pipe 88*b*. The throttle body 26 is arranged below the intake manifold 23 and connected to the intake manifold 23. A flame arrester 27 is arranged between the intake manifold 23 and the throttle body 26. Otherwise, the constituent features preferably are the same or substantially the same as the water jet propulsion watercraft 1 of the previously explained preferred embodiment.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A water jet propulsion watercraft comprising:

a hull;

an engine housed in the hull, the engine including a plurality of exhaust ports;

a jet propulsion unit arranged to be driven by the engine and configured to draw in water from around the hull and jet the water out;

an exhaust passage configured to guide exhaust gas from the engine to an exterior of the hull;

a catalytic converter unit including a catalyst member arranged in a catalyst housing of the exhaust passage;

a water lock arranged in the exhaust passage downstream of the catalyst member;

a first oxygen sensor arranged in the exhaust passage upstream of the catalyst member; and a second oxygen sensor arranged in the exhaust passage at a position downstream of the catalyst member and upstream of the water lock; wherein the exhaust passage includes a first pipe body arranged to face a side surface of the engine and configured to extend in a longitudinal direction of the watercraft;

the first oxygen sensor or the second oxygen sensor is arranged at a position higher than a widthwise oriented centerline of the first pipe body and closer to the engine in a widthwise direction of the watercraft than a vertically oriented centerline of the first pipe body when the first pipe body is viewed in a cross-section perpendicular to an axial centerline of the first pipe body;

an axial centerline of the catalyst housing extends in the widthwise direction of the watercraft; and the catalyst housing is located rearward of the engine.

2. The water jet propulsion watercraft according to claim 1, wherein the exhaust passage includes a pipe section in which the second oxygen sensor is installed; and an axial centerline of the pipe section is not parallel to an axial centerline of the water lock.

3. The water jet propulsion watercraft according to claim 1, wherein the exhaust passage includes a first pipe section in which the second oxygen sensor is installed and a second pipe section that is positioned downstream of the first pipe section and upstream of the water lock; and an axial centerline of the first pipe section is not parallel to an axial centerline of the second pipe section.

4. The water jet propulsion watercraft according to claim 1, wherein the exhaust passage includes a decreasing diameter section that is positioned downstream of the catalyst member and has a cross-sectional area that decreases as the decreasing diameter section extends in a downstream direction; and the second oxygen sensor is arranged in the decreasing diameter section or downstream of the decreasing diameter section in the exhaust passage.

5. The water jet propulsion watercraft according to claim 1, wherein the exhaust passage includes an exhaust manifold connected to the engine;

the exhaust manifold includes a plurality of branch pipes connected to the plurality of exhaust ports and a collector pipe connected to the branch pipes; and the branch pipes are configured to extend in a horizontal direction from the exhaust ports.

6. The water jet propulsion watercraft according to claim 1, wherein the exhaust passage includes an exhaust manifold connected to the engine;

the exhaust manifold includes a plurality of branch pipes connected to the plurality of exhaust ports and a collector pipe including a plurality of connection openings connected to the branch pipes;

the branch pipes are configured to extend laterally from the plurality of exhaust ports;

the collector pipe is configured to extend in a longitudinal direction of the watercraft along a side of the engine; and the first oxygen sensor is installed in the collector pipe and is positioned in a region including a connection opening that is positioned farthest downstream among the plurality of connection openings or at a position downstream of the region.

7. The water jet propulsion watercraft according to claim 1, wherein the exhaust passage includes a first exhaust pipe that connects the engine and the catalytic converter unit;

the first exhaust pipe includes a flexible pipe section; and the first oxygen sensor is positioned upstream of the flexible pipe section in the first exhaust pipe.

8. The water jet propulsion watercraft according to claim 1, wherein the exhaust passage includes a first exhaust pipe connected to the engine, the catalytic converter unit is connected to the first exhaust pipe, and a second exhaust pipe connects the catalytic converter unit and the water lock together; and bottom portions of internal surfaces of the first exhaust pipe, the catalytic converter unit, and the second exhaust pipe are configured such that there are no portions that slope upward in a downstream direction.

9. The water jet propulsion watercraft according to claim 1, wherein the catalyst member has a longitudinal centerline extending in the longitudinal direction of the watercraft, and the first oxygen sensor and the second oxygen sensor are arranged on opposing sides of the longitudinal centerline of the catalyst member.

10. A water jet propulsion unit comprising:

an engine including a plurality of exhaust ports;

a jet propulsion unit arranged to be driven by the engine and configured to draw in water and jet the water out;

an exhaust passage configured to guide exhaust gas from the engine;

a catalytic converter unit including a catalyst member arranged in a catalyst housing of the exhaust passage;

a water lock arranged in the exhaust passage downstream of the catalyst member;

a first oxygen sensor arranged in the exhaust passage upstream of the catalyst member; and a second oxygen sensor arranged in the exhaust passage at a position downstream of the catalyst member and upstream of the water lock; wherein the exhaust passage includes a first pipe body arranged to face a side surface of the engine and configured to extend in a longitudinal direction of the water jet propulsion unit;

the first oxygen sensor or the second oxygen sensor is arranged at a position higher than a widthwise oriented centerline of the first pipe body and closer to the engine in a widthwise direction of the water jet propulsion unit than a vertically oriented centerline of the first pipe body when the first pipe body is viewed in a cross-section perpendicular to an axial centerline of the first pipe body;

an axial centerline of the catalyst housing extends in the widthwise direction of the water jet propulsion unit; and the catalyst housing is located rearward of the engine.

11. The water jet propulsion unit according to claim 10, wherein the exhaust passage includes a pipe section in which the second oxygen sensor is installed; and an axial centerline of the pipe section is not parallel to an axial centerline of the water lock.

12. The water jet propulsion unit according to claim 10, wherein the exhaust passage includes a first pipe section in which the second oxygen sensor is installed and a second pipe section that is positioned downstream of the first pipe section and upstream of the water lock; and an axial centerline of the first pipe section is not parallel to an axial centerline of the second pipe section.

13. The water jet propulsion unit according to claim 10, wherein the exhaust passage includes a decreasing diameter section that is positioned downstream of the catalyst member and has a cross-sectional area that decreases as the decreasing diameter section extends in a downstream direction; and the second oxygen sensor is arranged in the decreasing diameter section or downstream of the decreasing diameter section in the exhaust passage.

14. The water jet propulsion unit according to claim 10, wherein the exhaust passage includes an exhaust manifold connected to the engine;

the exhaust manifold includes a plurality of branch pipes connected to the plurality of exhaust ports and a collector pipe connected to the branch pipes; and the branch pipes are configured to extend in a horizontal direction from the exhaust ports.

15. The water jet propulsion unit according to claim 10, wherein the exhaust passage includes an exhaust manifold connected to the engine;

the exhaust manifold includes a plurality of branch pipes connected to the plurality of exhaust ports and a collector pipe including a plurality of connection openings connected to the branch pipes;

the branch pipes are configured to extend laterally from the plurality of exhaust ports;

the collector pipe is configured to extend in a longitudinal direction of the water jet propulsion unit along a side of the engine; and the first oxygen sensor is installed in the collector pipe and is positioned in a region including a connection opening that is positioned farthest downstream among the plurality of connection openings or at a position downstream of the region.

16. The water jet propulsion unit according to claim 10, wherein the exhaust passage includes a first exhaust pipe that connects the engine and the catalytic converter unit;

the first exhaust pipe includes a flexible pipe section; and the first oxygen sensor is positioned upstream of the flexible pipe section in the first exhaust pipe.

17. The water jet propulsion unit according to claim 10, wherein the exhaust passage includes a first exhaust pipe connected to the engine, the catalytic converter unit is connected to the first exhaust pipe, and a second exhaust pipe connects the catalytic converter unit and the water lock together; and bottom portions of internal surfaces of the first exhaust pipe, the catalytic converter unit, and the second exhaust pipe are configured such that there are no portions that slope upward in a downstream direction.

18. The water jet propulsion unit according to claim 10, wherein the catalyst member has a longitudinal centerline extending in the longitudinal direction of the water jet propulsion unit, and the first oxygen sensor and the second oxygen sensor are arranged on opposing sides of the longitudinal centerline of the catalyst member.

* * * * *